US007401883B2

(12) United States Patent
Hoshiyama et al.

(10) Patent No.: US 7,401,883 B2
(45) Date of Patent: Jul. 22, 2008

(54) PRINTING METHOD AND PRINTING APPARATUS

(75) Inventors: Yoshiko Hoshiyama, Shiojiri (JP); Hirokazu Nunokawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/657,596

(22) Filed: Jan. 25, 2007

(65) Prior Publication Data

US 2007/0182783 A1 Aug. 9, 2007

(30) Foreign Application Priority Data

Jan. 26, 2006 (JP) ..... 2006-018164

(51) Int. Cl.
*B41J 29/393* (2006.01)

(52) U.S. Cl. ..... 347/19; 347/15

(58) Field of Classification Search ..... 347/15, 347/19, 43, 12; 358/1.2, 1.9
See application file for complete search history.

(56) References Cited

U.S. PATENT DOCUMENTS 6,375,294 B1 * 4/2002 Kneezel ..... 347/9
6,702,415 B2 * 3/2004 Kanda et al. ..... 347/15
6,976,748 B2 * 12/2005 Yabe et al. ..... 347/43

FOREIGN PATENT DOCUMENTS

JP 2001-293851 A 10/2001

* cited by examiner

*Primary Examiner*—Lamson D. Nguyen
(74) *Attorney, Agent, or Firm*—Sughrue Mion, PLLC

(57) ABSTRACT

Faster printing and higher image quality are both achieved at a high level. The printing method determines between a first print mode and a second print mode, and ejects ink from a head. In the first print mode, both a dark ink and a light ink used for printing gradually dark and light of a given color are used and printing is performed with a predetermined number of types of dot gradation values, which is a plurality of types of dot gradation values, based on the sizes of the dots to be formed. In the second print mode, one of the dark ink and the light ink is used and printing is performed with the number of dot gradation values that is larger than the predetermined number, which is a plurality of types of dot gradation values, based on the size of the dots to be formed. By ejecting ink from a head, a dot gradation value corresponding to the size of the dot to be formed is determined from among the types of the dot gradation values corresponding in number to the determined print mode, and dark ink and light ink is ejected from the head in accordance with the determined dot gradation value.

13 Claims, 22 Drawing Sheets

| 6 COLORS, 4 GRADATIONS | APPLIED DRIVING PULSES | | | |
|---|---|---|---|---|
| GRADATION / TYPE | NONE (00) | SMALL (01) | MEDIUM (10) | LARGE (11) |
| LIGHT CYAN INK | 4th | 6th | 5th | 1st, 3rd, 5th |
| DARK CYAN INK | 4th | 6th | 5th | 1st, 3rd, 5th |
| LIGHT MAGENTA INK | 4th | 6th | 5th | 1st, 3rd, 5th |
| DARK MAGENTA INK | 4th | 6th | 5th | 1st, 3rd, 5th |
| YELLOW INK | 4th | 6th | 5th | 1st, 3rd, 5th |
| BLACK INK | 4th | 6th | 5th | 1st, 3rd, 5th |
| INK EJECTION AMOUNT | 0pL | 1.6pL | 7pL | 21pL |

FIG. 13A

| 4 COLORS, 6 GRADATIONS | APPLIED DRIVING PULSES | | | | | |
|---|---|---|---|---|---|---|
| GRADATION / TYPE | NONE (000) | SMALL 1 (001) | SMALL 2 (100) | MEDIUM 1 (010) | MEDIUM 2 (101) | LARGE (011) |
| LIGHT CYAN INK | | | | | | |
| DARK CYAN INK | 4th | 6th | 2nd | 5th | 1st, 5th | 1st, 3rd, 5th |
| LIGHT MAGENTA INK | | | | | | |
| DARK MAGENTA INK | 4th | 6th | 2nd | 5th | 1st, 5th | 1st, 3rd, 5th |
| INK EJECTION AMOUNT | 0pL | 1.6pL | 2.5pL | 7pL | 14pL | 21pL |
| GRADATION / TYPE | NONE (00) | SMALL (01) | | MEDIUM (10) | | LARGE (11) |
| YELLOW INK | 4th | 6th | | 5th | | 1st, 3rd, 5th |
| BLACK INK | 4th | 6th | | 5th | | 1st, 3rd, 5th |
| INK EJECTION AMOUNT | 0pL | 1.6pL | | 7pL | | 21pL |

FIG. 13B

| 6 COLORS, 4 GRADATIONS | APPLIED DRIVING PULSES | | | |
|---|---|---|---|---|
| GRADATION / TYPE | NONE (00) | SMALL (01) | MEDIUM (10) | LARGE (11) |
| LIGHT CYAN INK | 5th | 7th | 3rd, 6th | 1st, 3rd, 6th, 8th |
| DARK CYAN INK | 5th | 7th | 3rd, 6th | 1st, 3rd, 6th, 8th |
| LIGHT MAGENTA INK | 5th | 7th | 3rd, 6th | 1st, 3rd, 6th, 8th |
| DARK MAGENTA INK | 5th | 7th | 3rd, 6th | 1st, 3rd, 6th, 8th |
| YELLOW INK | 5th | 7th | 3rd, 6th | 1st, 3rd, 6th, 8th |
| BLACK INK | 5th | 7th | 3rd, 6th | 1st, 3rd, 6th, 8th |
| INK EJECTION AMOUNT | 0pL | 1.6pL | 12pL | 24pL |

FIG. 18A

| 4 COLORS, 6 GRADATIONS (DARK) | APPLIED DRIVING PULSES | | | | | |
|---|---|---|---|---|---|---|
| GRADATION / TYPE | NONE (000) | SMALL 1 (001) | SMALL 2 (100) | MEDIUM 1 (010) | MEDIUM 2 (101) | LARGE (011) |
| DARK CYAN INK | 5th | 7th | 2nd | 3rd, 6th | 1st, 3rd, 6th | 1st, 3rd, 6th, 8th |
| DARK MAGENTA INK | 5th | 7th | 2nd | 3rd, 6th | 1st, 3rd, 6th | 1st, 3rd, 6th, 8th |
| INK EJECTION AMOUNT | 0pL | 1.6pL | 2.5pL | 12pL | 18pL | 24pL |
| GRADATION / TYPE | NONE (00) | SMALL (01) | | MEDIUM (10) | | LARGE (11) |
| YELLOW INK | 5th | 7th | | 3rd, 6th | | 1st, 3rd, 6th, 8th |
| BLACK INK | 5th | 7th | | 3rd, 6th | | 1st, 3rd, 6th, 8th |
| INK EJECTION AMOUNT | 0pL | 1.6pL | | 12pL | | 24pL |

FIG. 18B

| 4 COLORS, 6 GRADATIONS (LIGHT) | APPLIED DRIVING PULSES | | | | | |
|---|---|---|---|---|---|---|
| GRADATION / TYPE | NONE (000) | SMALL 1 (001) | SMALL 2 (100) | MEDIUM 1 (010) | MEDIUM 2 (101) | LARGE (011) |
| LIGHT CYAN INK | 5th | 2nd | 6th | 4th, 6th | 1st, 4th, 6th | 1st, 4th, 6th, 8th |
| LIGHT MAGENTA INK | 5th | 2nd | 6th | 4th, 6th | 1st, 4th, 6th | 1st, 4th, 6th, 8th |
| INK EJECTION AMOUNT | 0pL | 2.5pL | 6pL | 15pL | 21pL | 27pL |
| GRADATION / TYPE | NONE (00) | SMALL (01) | | MEDIUM (10) | | LARGE (11) |
| YELLOW INK | 5th | 7th | | 3rd, 6th | | 1st, 3rd, 6th, 8th |
| BLACK INK | 5th | 7th | | 3rd, 6th | | 1st, 3rd, 6th, 8th |
| INK EJECTION AMOUNT | 0pL | 1.6pL | | 12pL | | 24pL |

FIG. 18C

PRINTING METHOD AND PRINTING APPARATUS

CROSS-REFERENCE TO RELATED APPLICATION

The present application claims priority upon Japanese Patent Application No. 2006-18164 filed on Jan. 26, 2006, which is herein incorporated by reference.

BACKGROUND

1. Technical Field

The present invention relates to printing methods and printing apparatuses.

2. Related Art

There are printers, plotters and facsimile devices and the like that are printing apparatuses employing the so-called inkjet method, in which ink is ejected from a head. Among such printing apparatuses, there are some in which the print mode can be switched to perform printing (see for example JP-A-2001-293851). In such a printing apparatus, the number of passes of the main scan is determined individually for each of a plurality of individual regions in an overall region, and the recording is performed in this predetermined number of passes.

In such a printing apparatus, variation in the ejection state of the ink from each nozzle is suppressed by increasing the number of passes. Thus, it is possible to improve the quality of the printed images. However, there is a need for further improvement, in order to achieve both higher print speeds and higher image quality.

SUMMARY

The present invention has been conceived in view of the above-described circumstances, and one of its principal objects is to establish both faster printing and higher image quality at a high level.

A primary aspect of the present invention is a printing method such as the following.

A printing method including:

determining either one of a first print mode, which uses both a dark ink and a light ink used for printing gradually dark and light of a given color and which prints with a predetermined number of types of dot gradation values, which is a plurality of types of dot gradation values, based on sizes of dots to be formed, and a second print mode, which uses one of the dark ink and the light ink and which prints with the number of types of dot gradation values larger than the predetermined number, which is a plurality of types of dot gradation values, based on the sizes of the dots to be formed; and determining a dot gradation value corresponding to the size of the dot to be formed, from among the number of the types of the dot gradation values corresponding to the determined print mode, and ejecting the dark ink and the light ink from a head in accordance with the determined dot gradation value.

Other features of the present invention will become clear through the accompanying drawings and the following description.

BRIEF DESCRIPTION OF THE DRAWINGS

For a more complete understanding of the present invention and the advantages thereof, reference is now made to the following description taken in conjunction with the accompanying drawings.

FIG. 13A is a diagram illustrating the driving pulse applied to the piezo elements and the amount of ink ejected in the high-quality mode for each type of ink and for each dot formation data.

FIG. 13B is a diagram illustrating the driving pulse applied to the piezo elements and the amount of ink ejected in the high-speed mode for each type of ink and for each dot formation data.

FIG. 18A is a diagram illustrating the driving pulse applied to the piezo elements and the amount of ink ejected in the high-quality mode for each type of ink and for each dot formation data.

FIG. 18B is a diagram illustrating the driving pulse applied to the piezo elements and the amount of ink ejected in the first high-speed mode for each type of ink and for each dot formation data.

FIG. 18C is a diagram illustrating the driving pulse applied to the piezo elements and the amount of ink ejected in the second high-speed mode for each type of ink and for each dot formation data.

DESCRIPTION OF EXEMPLARY EMBODIMENTS

Figure 1:
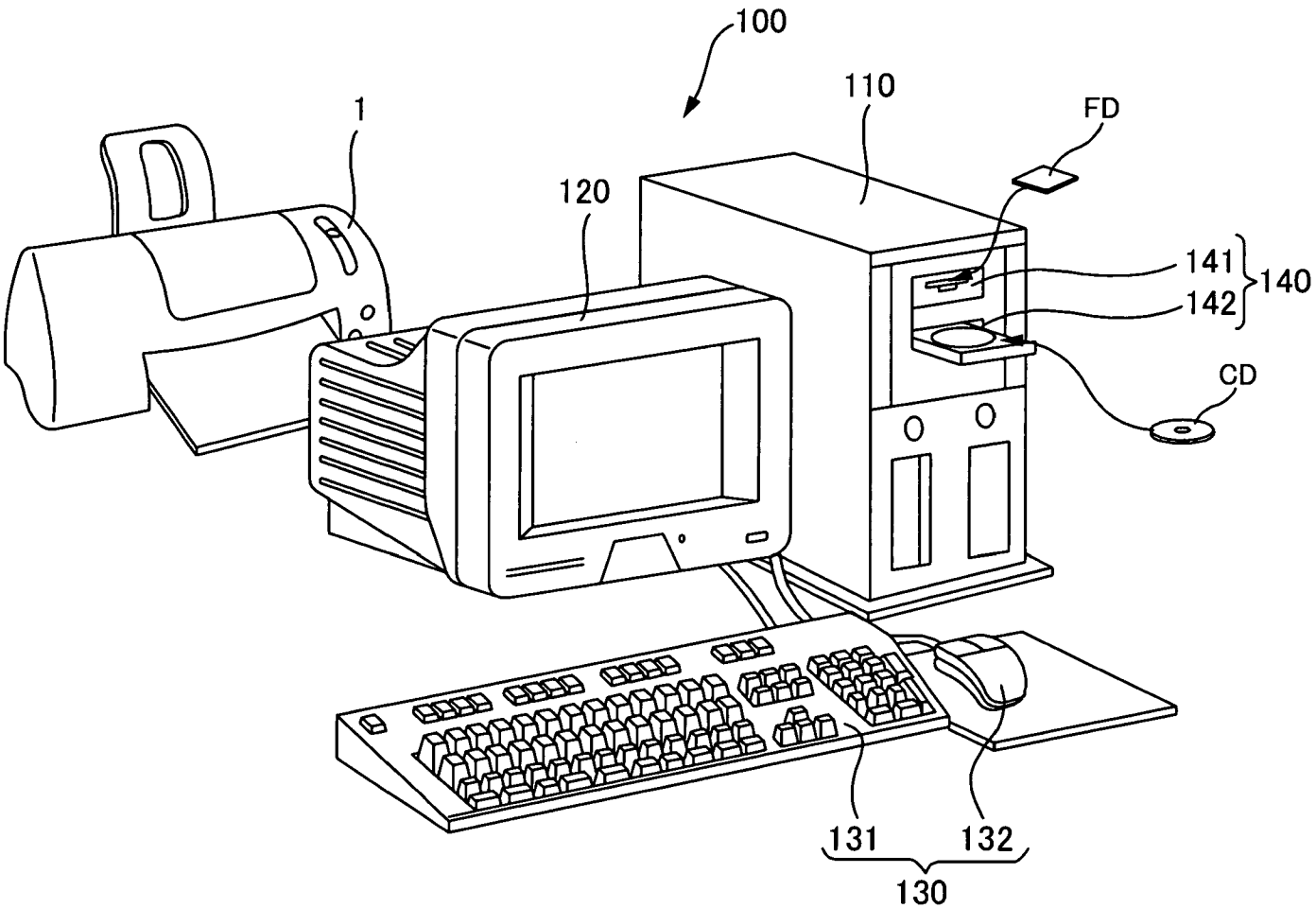
FIG. 1 is a diagram illustrating the configuration of a printing system.

At least the following matters will be made clear by the present specification and the accompanying drawings.

A printing method including:

determining either one of a first print mode, which uses both a dark ink and a light ink used for printing gradually dark and light of a given color and which prints with a predetermined number of types of dot gradation values, which is a plurality of types of dot gradation values, based on sizes of dots to be formed, and a second print mode, which uses one of the dark ink and the light ink and which prints with the number of types of dot gradation values larger than the predetermined number, which is a plurality of types of dot gradation values, based on the sizes of the dots to be formed; and determining a dot gradation value corresponding to the size of the dot to be formed, from among the number of the types of the dot gradation values corresponding to the determined print mode, and ejecting the dark ink and the light ink from a head in accordance with the determined dot gradation value.

With this printing method, fewer types of ink are used in the second print mode than in the first print mode, so that the load on the control can be reduced and faster processing can be achieved. Furthermore, in the second print mode, the number of dot gradation values is set to a larger number than in the first print mode, so that it is possible to suppress a deterioration of image quality that is caused by the fact that the number of inks used is small. That is to say, it is possible to print with higher image quality in the first print mode, and it is possible to print faster while suppressing a deterioration of image quality in the second print mode. By selecting these print modes, it is possible to achieve, at a high level, both faster printing and higher image quality.

It is preferable that this printing method further includes, if the first print mode is determined as the print mode performing a control and if for another of the dark ink and the light ink, a remaining ink amount detected by a remaining ink amount detector is smaller than a reference amount, switching the print mode performing the control from the first print mode to the second print mode.

With this printing method, printing can be continued in the second print mode, even when one of the dark ink and the light ink has become little in the first print mode. Consequently, the ink can be used efficiently.

In this printing method, it is preferable that in the first print mode, both the dark ink and the light ink used for printing gradually dark and light of a given color as well as both another dark ink and another light ink used for printing gradually dark and light of another color are used, and printing is performed with a predetermined number of types of dot gradation values, which is a plurality of types of dot gradation values, based on the sizes of the dots to be formed, and in the second print mode, one of the dark ink and the light ink as well as one of the other dark ink and the other light ink are used, and printing is performed with the number of types of dot gradation values larger than the predetermined number, which is a plurality of types of dot gradation values, based on the sizes of the dots to be formed, and if the print mode performing the control is switched from the first print mode to the second print mode, for the other dark ink and the other light ink, regardless of the remaining ink amount of another of the other dark ink and the other light ink, one of the other dark ink and the other light ink is used, and printing is performed using the number of types of dot gradation values larger than the predetermined number.

With this printing method, if there are a plurality of colors for which dark ink and light ink is used to print a gradual transition between dark and light, when the second print mode is specified for a given color, then the second print mode is specified also for the other colors. Thus, problems caused by differences in the printing mode, such as the problem that the color balance between one color and another color is destroyed, can be prevented.

In this printing method, it is preferable that the dark ink and the light ink are one of a cyan dark ink and light ink and a magenta dark ink and light ink, and the other dark ink and the other light ink are another of the cyan dark ink and light ink and the magenta dark ink and light ink.

With this printing method, for one of the cyan dark ink and light ink and the magenta dark ink and light ink, the second print mode is set, and also for the other, the second print mode is set. Thus, the problem that the balance between cyan and magenta is destroyed in the second print mode can be prevented.

In this printing method, it is preferable that the remaining ink amount detector includes counters counting the number of ink ejections individually for each ink type and detects the remaining ink amount individually for each type of the ink, based on the count values of the counters.

With such a printing method, it is possible to detect the remaining amount of ink for each type of ink individually with a simple configuration.

In this printing method, it is preferable that the remaining ink amount detector stores the count values of the counters in a non-volatile memory of an ink storage container in which ink is stored.

With this printing method, it is possible to identify the remaining ink amounts with high precision, even when an ink storage container is dismounted while containing a remaining ink amount that is larger than the reference amount, and is mounted again.

In this printing method, it is preferable that the reference amount is an amount that is determined based on a remaining ink amount at which damage is caused when printing.

With such a printing method, it is possible to switch the print mode before damage is caused by printing.

In this printing method, it is preferable that the head includes a plurality of nozzle rows each made of a plurality of nozzles from which ink is ejected, the nozzle rows being lined up in a movement direction of the head, and ink not used in the second print mode is ejected from nozzle rows, of a plurality of the nozzle rows, that are positioned at one end in the movement direction.

With this printing method, it is possible to make the movement range of the head in the second print mode narrower than the printing range of the head in the first print mode. Therefore, the printing is sped up even further.

In this printing method, it is preferable that the head includes a plurality of nozzle rows each made of a plurality of nozzles from which ink is ejected, the nozzle rows being lined up in a movement direction of the head, and nozzle rows not ejecting ink in the second print mode are not positioned between nozzle rows, of a plurality of the nozzle rows, ejecting ink in the second print mode.

With this printing method, it is possible to make the movement range of the head in the second print mode narrower than the printing range of the head in the first print mode. Therefore, the printing is sped up even further.

In this printing method, it is preferable that in the second print mode, the dark ink is used, and a difference of an ink amount for a given dot gradation value and the next dot gradation value is smaller than a difference between an ink amount for a given dot gradation value and the next dot gradation value in the first print mode.

With this printing method, the extent of the change between dark and light for the dark ink in the second print mode can be adjusted more precisely than the extent of the change between dark and light for the dark ink in the first print mode. Thus, it is possible to suppress a deterioration of image quality caused by the fact that no light ink is used.

In this printing method, it is preferable that in the second print mode, the light ink is used, and the amount of the light ink that is ejected at a maximum dot gradation value is larger than the amount of the light ink that is ejected at a maximum dot gradation value of the first print mode.

With this printing method, the maximum print resolution for light ink in the second print mode can be made darker than the maximum print resolution for light ink in the first mode. Thus, it is possible to suppress a deterioration of image quality caused by the fact that no dark ink is used.

In this printing method, to eject ink from the head, a plurality of driving signals are generated in a given period, a necessary portion is selected from a plurality of the driving signals, in accordance with the determined print mode, and the selected necessary portion is applied to an element of the head, the element performing an operation causing ink to be ejected.

With this printing method, even when increasing the number of types of dot formation data in the second print mode, it can be prevented that the generation time of the driving signals becomes too long, and thus a speeding up of the printing process can be achieved.

In this printing method, in the first print mode, both the dark ink and the light ink stored in an ink storage container are used, and the ink storage container includes a case provided with a plurality of ink storage chambers, and a plurality of types of inks including the dark ink and the light ink used for gradation printing of the given color and an ink other than the dark ink and the light ink of the given color are stored in the corresponding ink storage chambers, and in the second print mode, one of the dark ink and the light ink stored in the ink storage container is used.

With such a printing method, even when the other of the dark ink and the light ink is used up, in the second print mode, printing can be carried out using the one of the dark ink and the light ink. Therefore, it is possible to use one ink storage container for a long period of time.

It is also possible to achieve a printing apparatus such as the following.

A printing apparatus, including:

a head ejecting dark ink and light ink used for printing dark and light gradually of a given color in accordance with dot gradation values determined from among a plurality of types of dot gradation values based on the sizes of dots to be formed, and a controller performing control with a print mode determined from a first print mode using both the dark ink and the light ink and performing printing with a predetermined number of types of dot gradation values, and a second print mode using one of the dark ink and the light ink and performing printing with the number of types of dot gradation values larger than the predetermined number.

First Embodiment

Configuration of Printing System 100

First, the overall configuration of a printing system 100 is explained. FIG. 1 is a diagram illustrating the configuration of a printing system 100. The printing system 100, which is shown as an example, includes a printer 1 and a computer 110, and functions as a printing apparatus. More specifically, the printing system 100 includes a printer 1, a computer 110, a display device 120, input devices 130, and recording/reproducing devices 140. The printer 1 prints images on a medium such as paper, cloth, or film. It should be noted that the following description is made for paper S (see FIG. 3A), which is a representative medium, as an example. The computer 110 is connected such that it can communicate with the printer 1. In order to let the printer 1 print an image, the computer 110 outputs print data corresponding to this image to the printer 1. Computer programs, such as an application program and a printer driver, are installed on the computer 110. The display device 120 includes a display. The display device 120 displays for example a user interface of the computer programs. The input devices 130 are for example a keyboard 131 and a mouse 132. The recording/reproducing devices 140 are for example a flexible disk drive 141 and a CD-ROM drive 142.

Computer 110

Configuration of the Computer 110

Figure 2:
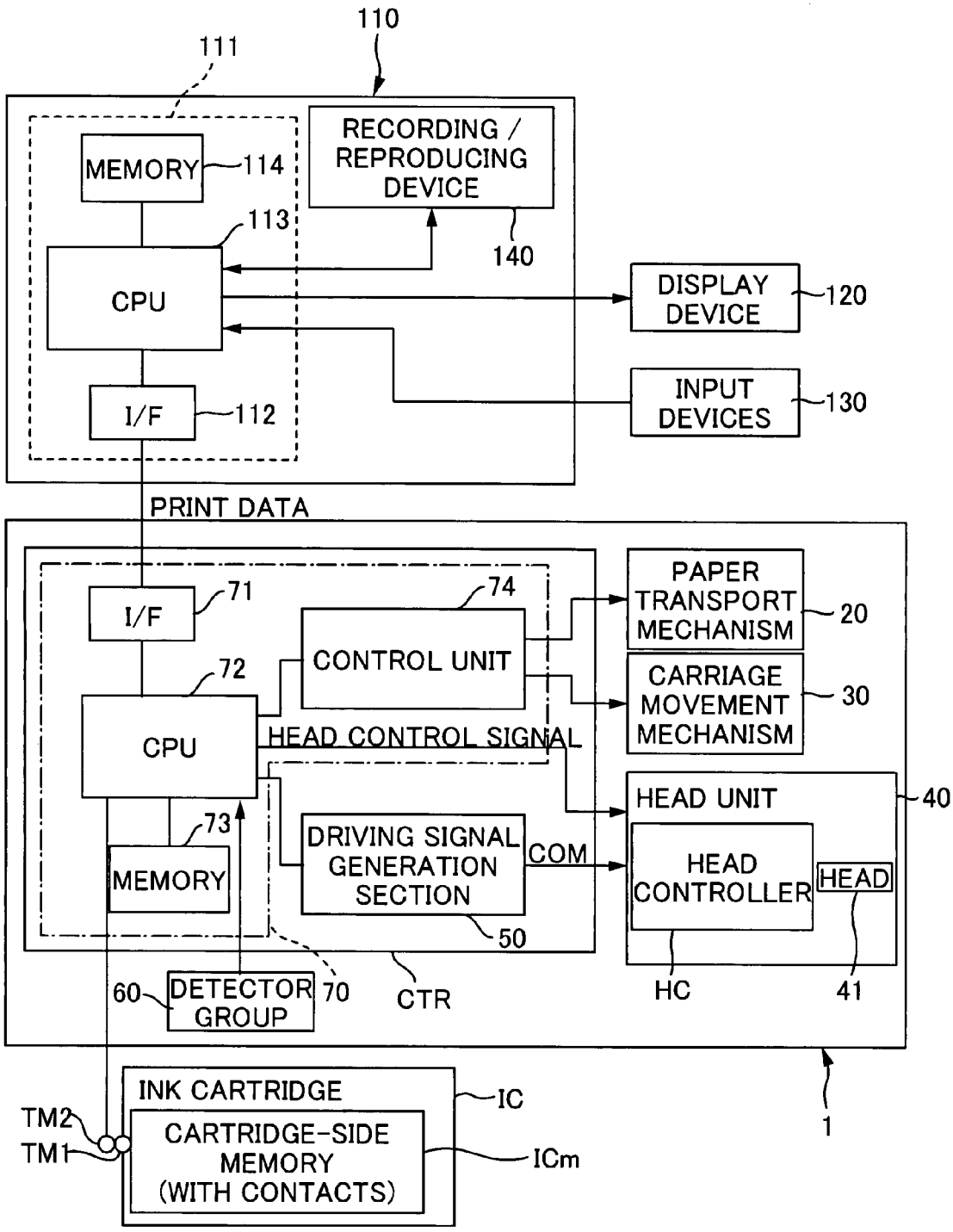
FIG. 2 is a block diagram illustrating the configuration of a computer and a printer.

FIG. 2 is a block diagram illustrating the configuration of the computer 110 and the printer 1. First, the configuration of the computer 110 is explained in simple terms. The computer 110 includes a recording/reproducing device 140, as mentioned above, and a host-side controller 111. The recording/reproducing device 140 is connected such that it can communicate with the host-side controller 111 and is attached to the case of the computer 110, for example. The host-side controller 111 performs various kinds of controls in the computer 110, and is connected such that it can communicate with the above-noted display device 120 and also with the input devices 130. This host-side controller 111 includes an interface section 112, a CPU 113 and a memory 114. The interface section 112 interfaces with the printer 1 and exchanges data with it. The CPU 113 is an arithmetic processing device for carrying out the overall control of the computer 110. The memory 114 is for ensuring an area to store the computer programs used by the CPU 113 and a working area, and is configured by a RAM, EEPROM, ROM, magnetic disk device or the like. As mentioned above, examples of computer programs stored in this memory 114 are application programs and printer drivers. These application programs and printer drivers can be provided through flexible disks FD or compact disks CD, for example. The CPU 113 performs various controls in accordance with the computer programs stored in the memory 114.

It should be noted that in this printing system 100, the printer 1 can print with a print mode that is selected from a plurality of print modes. Moreover, in which of these print modes the printing is performed is decided by a host-side controller 111, which executes the printer driver. Therefore, in the present embodiment, the host-side controller 111 that executes the printer driver configures a controller that performs the print control together with a printer-side controller 70 and head controllers HC, which are explained later. For the sake of convenience, in the present specification, the operation of the host-side controller 111 that executes the printer driver is explained as the operation of the printer driver.

Figure 7A:
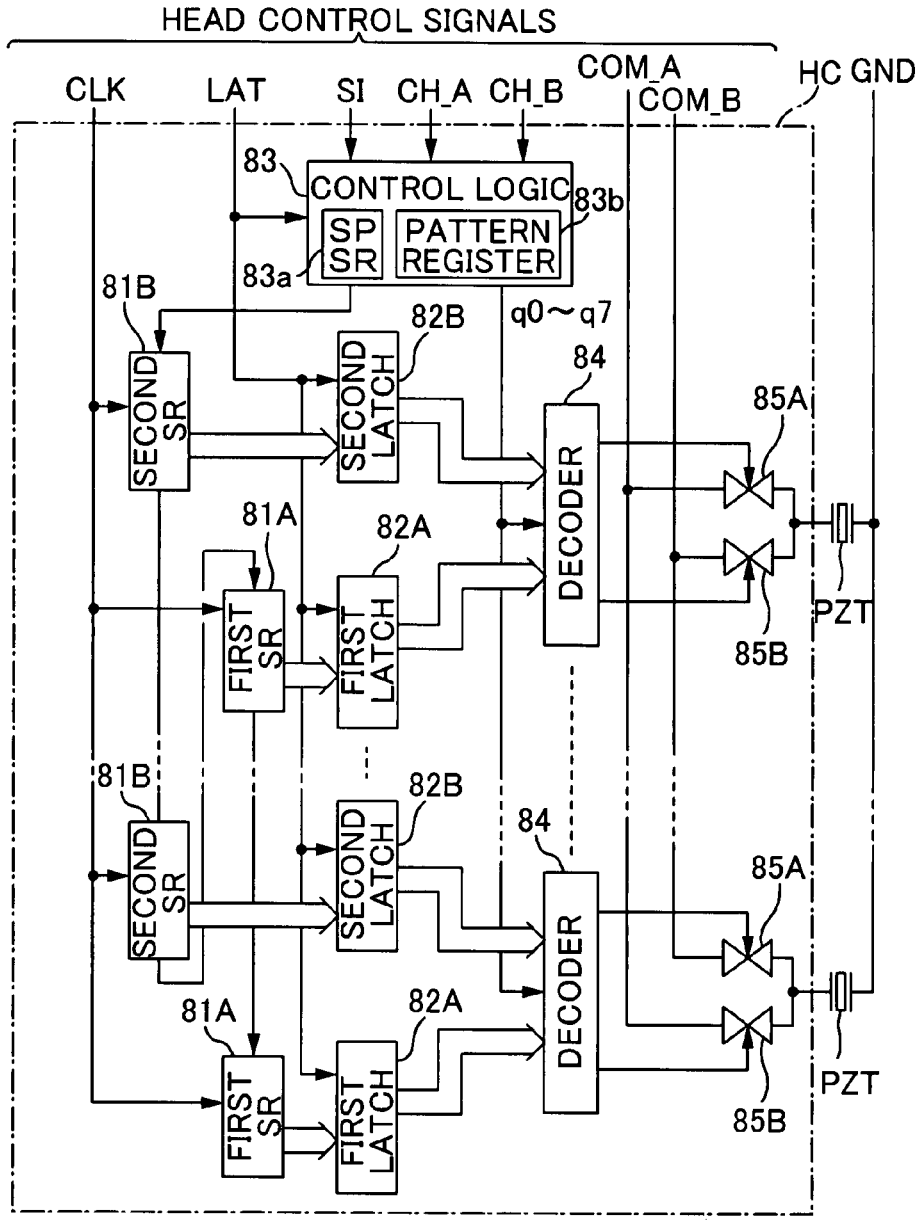
FIG. 7A is a diagram illustrating a head controller of the type for four types of dot formation data.
Figure 8:
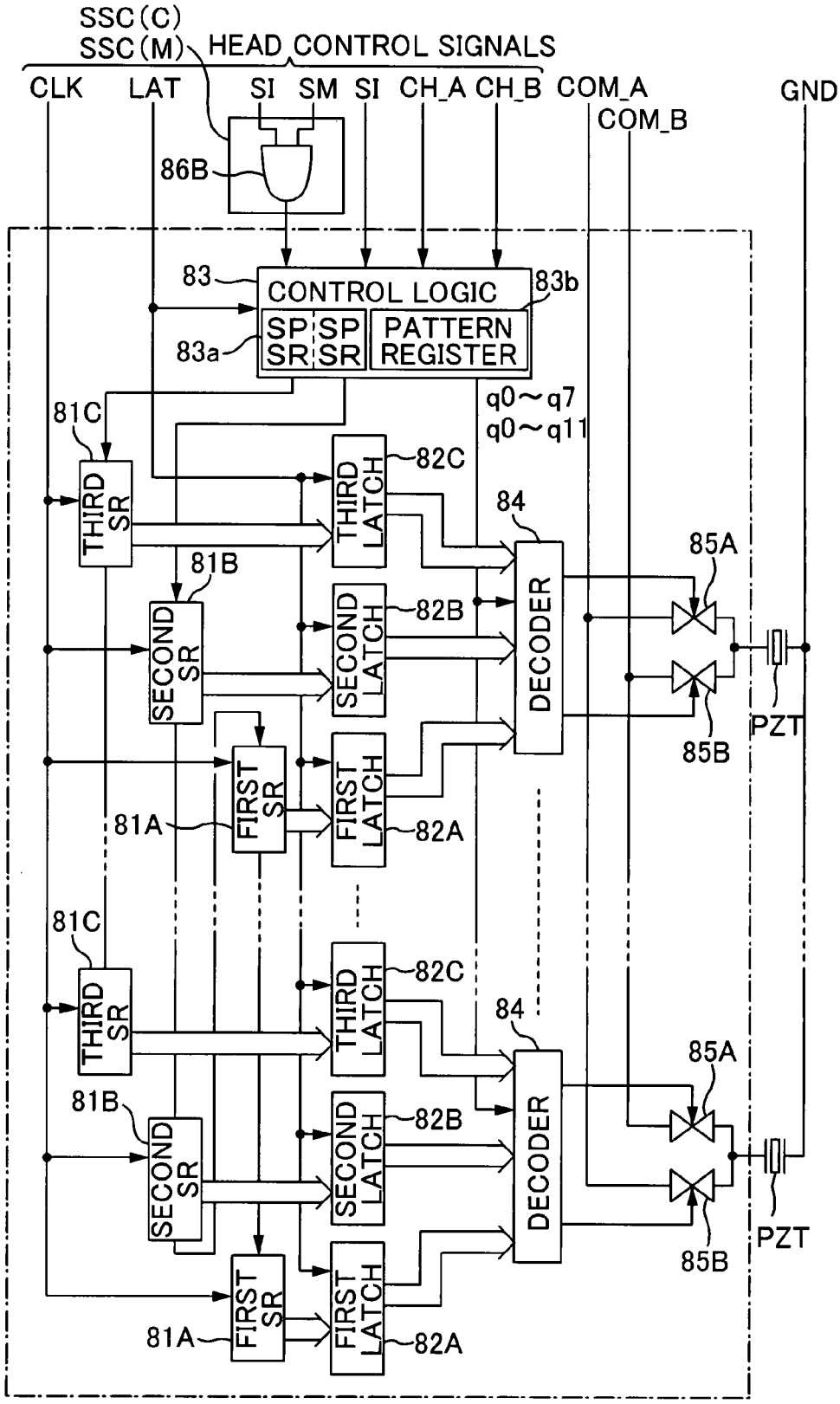
FIG. 8 is a diagram illustrating a head controller of the type switching between four and six types of dot formation data.

The print data is data that has a format that can be interpreted by the printer 1 and includes various kinds of command data and dot formation data SI (see FIGS. 7A and 8). Command data is data for letting the printer 1 execute a specific operation. As such command data, there is for example command data instructing paper supply, command date indicating the transport amount, and command data instructing paper discharge. Moreover, the dot formation data SI is data relating to the dots of the printed image. Here, the dots are formed in correspondence with virtual square boxes on the paper S (also referred to in the following as "unit regions"). Moreover, the dot formation data SI corresponds to dot gradation values based on the size of the dots to be formed.

In the present embodiment, the dot formation data SI (dot gradation values) is constituted by 2-bit data or by 3-bit data. For example, in a high-quality mode (corresponding to a first print mode), in which for cyan, printing gradually dark and light (also referred to as gradation printing) is printed using dark cyan ink and light cyan ink, and also for magenta, printing gradually dark and light is printed using dark magenta ink and light magenta ink, printing is performed with six types of ink, namely black ink, yellow ink, dark cyan ink, light cyan ink, dark magenta ink and light magenta ink. In this case, the dot formation data SI is constituted by 2-bit data. That is to say, the dot formation data SI includes data [00] corresponding to no dots (no ejection of ink), data [01] corresponding to the formation of small dots, data [10] corresponding to the formation of medium dots, and data [11] corresponding to the formation of large dots. Consequently, in this high-quality mode, for any kind of ink, it is possible to select among four types of dot formation data SI for each unit region. Moreover, in the high-speed mode (corresponding to the second print mode) in which printing gradually dark and light is performed using only dark cyan ink for cyan and only dark magenta ink for magenta, printing is performed with four types of ink, namely black ink, yellow ink, dark cyan ink and dark magenta ink. Moreover, the dot formation data SI for black ink and yellow ink is constituted by 2-bit data, whereas the dot formation data SI for dark cyan ink and dark magenta ink is constituted by 3-bit data. In this high-speed mode, it is possible to select between four types of dot formation data SI for one unit region for black ink and for yellow ink, as in the high-quality mode. On the other hand, for dark cyan ink and for dark magenta ink, the dot formation data SI includes data [000] corresponding to no dots, data [001] corresponding to the formation of first small dots, data [100] corresponding to the formation of second small dots, data [010] corresponding to the formation of first medium dots, data [101] corresponding to the formation of second medium dots, data [011] corresponding to the formation of large dots. Consequently, for dark cyan ink and dark magenta ink, it is possible to select among six types of dot formation data SI for each unit region.

Moreover, the printer driver (host-side controller 111) functions as a remaining ink amount detector, which detects the amount of ink remaining in the ink cartridge IC. In the present embodiment, the printer driver counts the number of ink ejections for each type of ink. For example, the printer driver uses a predetermined region of the memory 114 as counters and counts the number of ink ejections with these counters for each type of ink individually. The printer driver detects the remaining ink amount from the initial storage amount of ink and the amount of consumed ink based on the count values. Thus, it is possible to detect the remaining amount of ink for each type of ink individually with a simple configuration. Moreover, when the printer driver determines the high-quality mode as the print mode, the print mode is switched to the high-speed mode under the condition that the remaining ink amount of light cyan ink or light magenta ink is below a certain reference amount. This aspect is described further below.

Furthermore, the count values according to the counters are stored in a cartridge-side memory ICm (described below) of the ink cartridge IC. Also, by reading out the count values from the cartridge-side memory ICm each time the power is turned on, the printer driver can acquire the remaining ink amount. Moreover, even when the ink cartridge IC is exchanged, it is possible to determine the remaining ink amount for the exchanged ink cartridge IC.

Printer 1

Configuration of the Printer 1

Figure 3A:
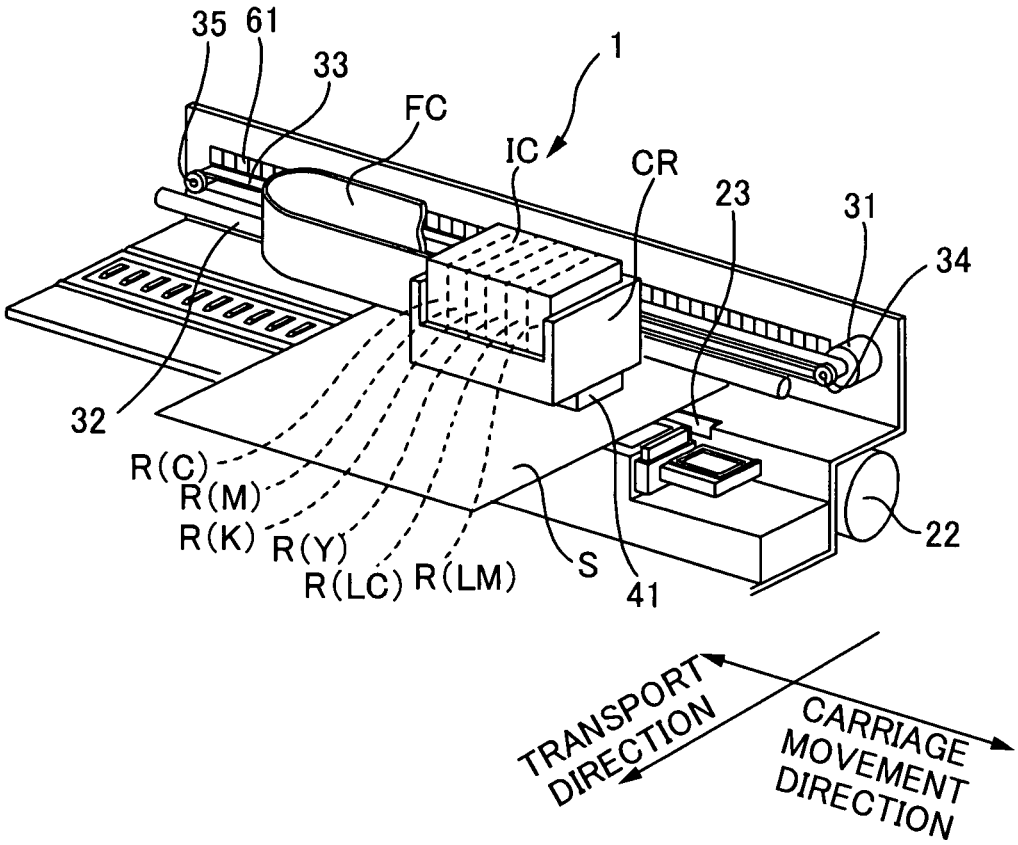
FIG. 3A is a diagram showing the configuration of the printer.
Figure 3B:
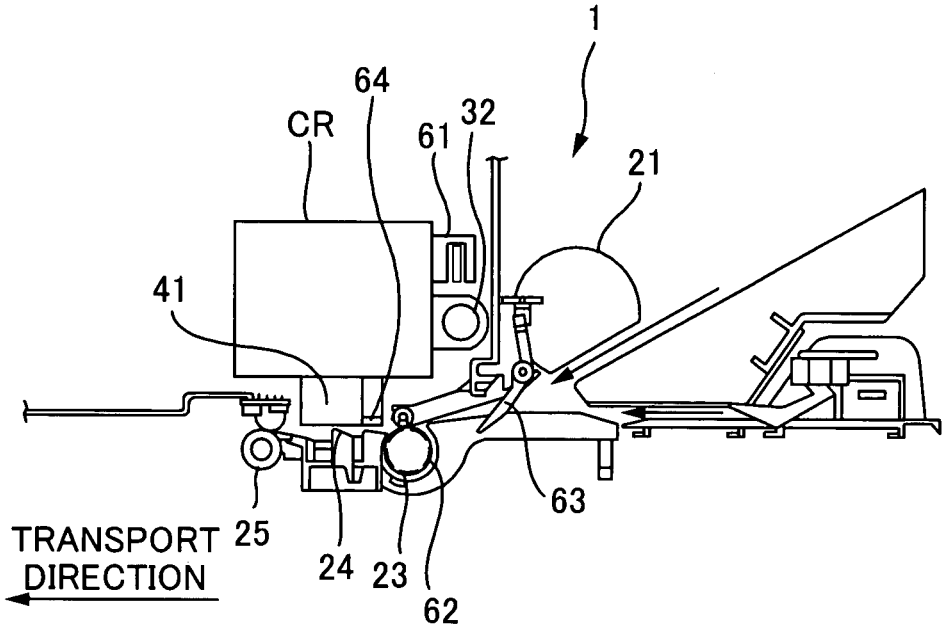
FIG. 3B is a lateral view illustrating the configuration of the printer.

The configuration of the printer 1 is described next. Here, FIG. 3A is a diagram showing the configuration of the printer 1 of the present embodiment. FIG. 3B is a lateral view illustrating the configuration of the printer 1 of the present embodiment. The following explanations also refer to FIG. 2. As shown in FIG. 2, the printer 1 includes a paper transport mechanism 20, a carriage movement mechanism 30, a head unit 40, a driving signal generation section 50, a detector group 60, and a printer-side controller 70. The driving signal generation section 50 and the printer-side controller 70 are mounted on the same controller board CTR. Moreover, the head unit 40 includes a head controller HC and a head 41. In this printer 1, all parts to be controlled, that is, the paper transport mechanism 20, the carriage movement mechanism 30, the head unit 40 (head controller HC and head 41) and the driving signal generation section 50 are controlled by the printer-side controller 70. That is to say, the printer-side controller 70 controls the parts to be controlled based on the print data received from the computer 110 and prints the image on the paper S. In this situation, the detectors of the detector group 60 detect the state of the various components inside the printer 1, and output the detection result to the printer-side controller 70. The printer-side controller 70 receives the detection results from the detectors, and controls the parts to be controlled based on these detection results.

Paper Transport Mechanism 20

The paper transport mechanism 20 corresponds to a medium transport section for transporting a medium. The paper transport mechanism 20 feeds the paper S serving as a medium up to a printable position, and transports the paper S by a predetermined transport amount in the transport direction. This transport direction is the direction intersecting the carriage movement direction, which is explained next. As shown in FIGS. 3A and 3B, the paper transport mechanism 20 includes a paper supply roller 21, a transport motor 22, a transport roller 23, a platen 24, and a paper discharge roller 25. The paper supply roller 21 is a roller for feeding the paper S that has been inserted into a paper insert opening into the printer 1. The transport motor 22 is a driving source for transporting the paper S in the transport direction. The transport roller 23 is a roller for transporting the paper S that has been fed by the paper supply roller 21 to a printable region. The platen 24 is a member for supporting the paper S from its rear side. The paper discharge roller 25 is a roller for transporting the paper S on which printing has finished.

Carriage Movement Mechanism 30

The carriage movement mechanism 30 is for moving the carriage CR to which the head unit 40 is attached in the carriage movement directions. The carriage movement directions include the movement direction from one side to the other side as well as the movement direction back from the other side to the one side. The head unit 40 includes a head 41. Therefore, the carriage movement directions correspond to the movement directions of the head 41 (also referred to as "head movement directions" in the following). Furthermore, the carriage movement mechanism 30 corresponds to a head movement section moving the head 41 in the head movement directions. The carriage movement mechanism 30 includes a carriage motor 31, a guide shaft 32, a timing belt 33, a drive pulley 34, and an idler pulley 35. The carriage motor 31 corresponds to a driving source for moving the carriage CR. The operation of this carriage motor 31 is controlled by the printer-side controller 70. The drive pulley 34 is attached to a rotation shaft of the carriage motor 31. This drive pulley 34 is arranged at one end side in the carriage movement direction. The idler pulley 35 is arranged at the other end side in the carriage movement direction, on the opposite side of the drive pulley 34. The timing belt 33 is an annular member, to the end of which the carriage CR is fixed, and is suspended by the drive pulley 34 and the idler pulley 35. The guide shaft 32 supports the carriage CR in a movable state. The guide shaft 32 is attached extending in the carriage movement direction. Consequently, when the carriage motor 31 is operated, the carriage CR moves in the carriage movement direction along the guide shaft 32. Accordingly, also the head 41 moves in the head movement direction.

Ink Cartridge IC

An ink cartridge IC, in which ink is stored, is mounted to the carriage CR. This ink cartridge IC corresponds to an ink storage container. Furthermore, the carriage CR corresponds to a mounting section to which the ink cartridge IC is mounted.

The ink cartridge IC is a member in which a plurality of types of liquid ink to be ejected is stored. The ink cartridge IC includes a case that is provided with a plurality of ink storage chambers R(C) to R(LM). The ink storage chambers R(C) to R(LM) store corresponding inks. That is to say, dark cyan ink is stored in the ink storage chamber R(C) and dark magenta ink is stored in the ink storage chamber R (M). Black ink is stored in the ink storage chamber R(K) and yellow ink is stored in the ink storage chamber R(Y). Similarly, light cyan ink is stored in the ink storage chamber R(LC) and light magenta ink is stored in the ink storage chamber R(LM).

The dark cyan ink corresponds to dark ink that is used for printing gradually dark and light of cyan, and the light cyan ink corresponds to the light ink that is used for printing gradually dark and light of cyan. Similarly, the dark magenta ink corresponds to dark ink that is used for printing gradually dark and light of magenta, and the light magenta ink corresponds to the light ink that is used for printing gradually dark and light of magenta. The light cyan ink is adjusted such that the ratio of its density to the density of dark cyan ink is 1/n. This intensity ratio is obtained, for example, by comparing the optical density that is obtained by solid printing of dark cyan ink on a given paper S with the optical density that is obtained by solid printing of light cyan ink on the same paper S. This is the also the same for dark and light magenta ink.

Moreover, one of cyan and magenta corresponds to "one color" with which printing gradually dark and light is performed and the other of cyan and magenta is "another color" with which printing gradually dark and light is performed. Consequently, the ink cartridge IC holds a plurality of kinds of inks including dark ink and light ink used for printing gradually one color, dark ink and light ink used for printing gradually another color, and other inks, in corresponding storage chambers.

As shown in FIG. 2, the ink cartridge IC is provided with a cartridge-side memory ICm. This cartridge-side memory ICm is constituted by a non-volatile memory. Moreover, ink type information representing the types of ink that are held is stored in the cartridge-side memory ICm. Moreover, other information, such as consumption amount information relating to the consumed amount of ink, is also stored in the cartridge-side memory ICm. The cartridge-side memory ICm is furthermore provided with a contact terminal (referred to as "memory-side contact terminal TM1" for convenience). In the state in which the ink cartridge IC is mounted to the carriage CR, this memory-side contact terminal TM1 is in contact with the contact terminal provided on the carriage side (referred to as "carriage-side contact terminal TM2" for convenience). The carriage-side contact terminal TM2 is connected by wiring to the printer-side controller 70 (CPU 72). Therefore, when the ink cartridge IC is mounted, the printer-side controller 70, which constitutes part of the driving signal generation section, can obtain the ink type information or the consumption amount information. The consumption amount information is stored in the cartridge-side memory ICm, so that even if an ink cartridge IC is dismounted before the time for exchanging it has come (that is, with a remaining ink amount that is larger than the reference amount) and is mounted again, then it is still possible to accurately determine the remaining ink amount with the printer driver.

Head Unit 40

Figure 4A:
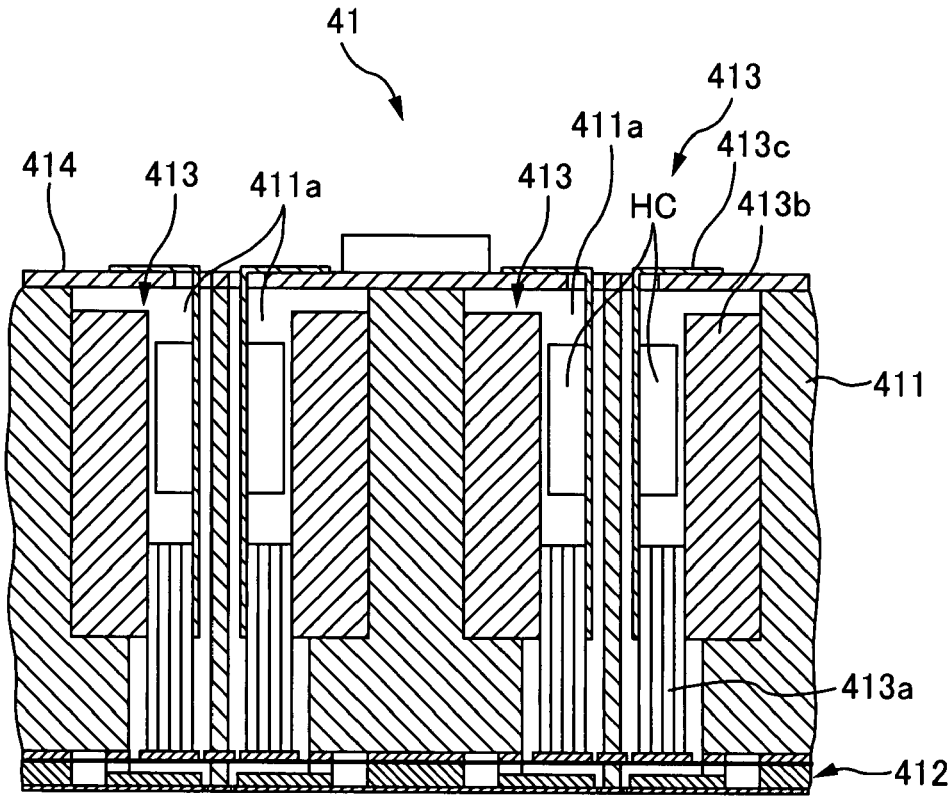
FIG. 4A is a cross-sectional view illustrating the structure of the head.
Figure 4B:
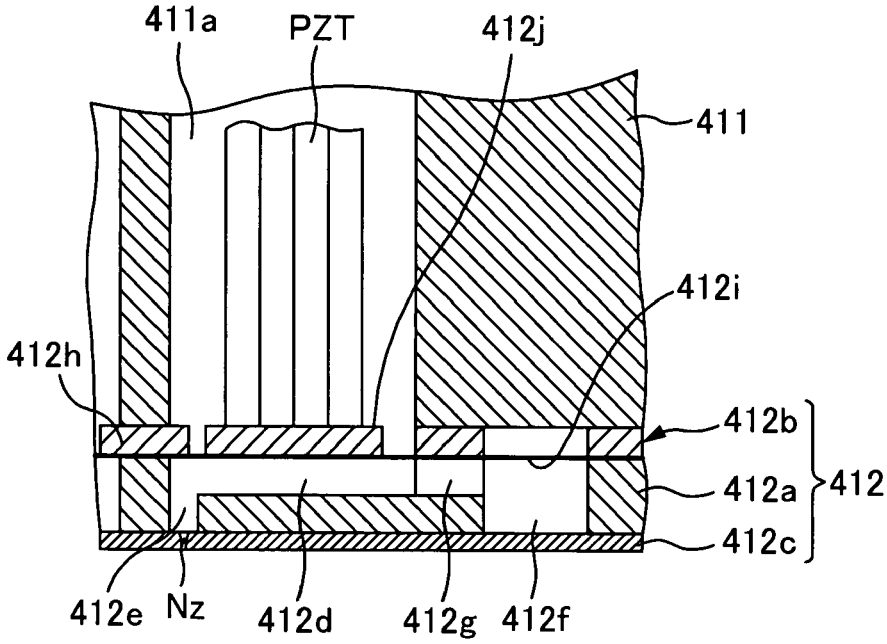
FIG. 4B is a cross-sectional view showing, in magnification, the principal portions of the head.
Figure 5:
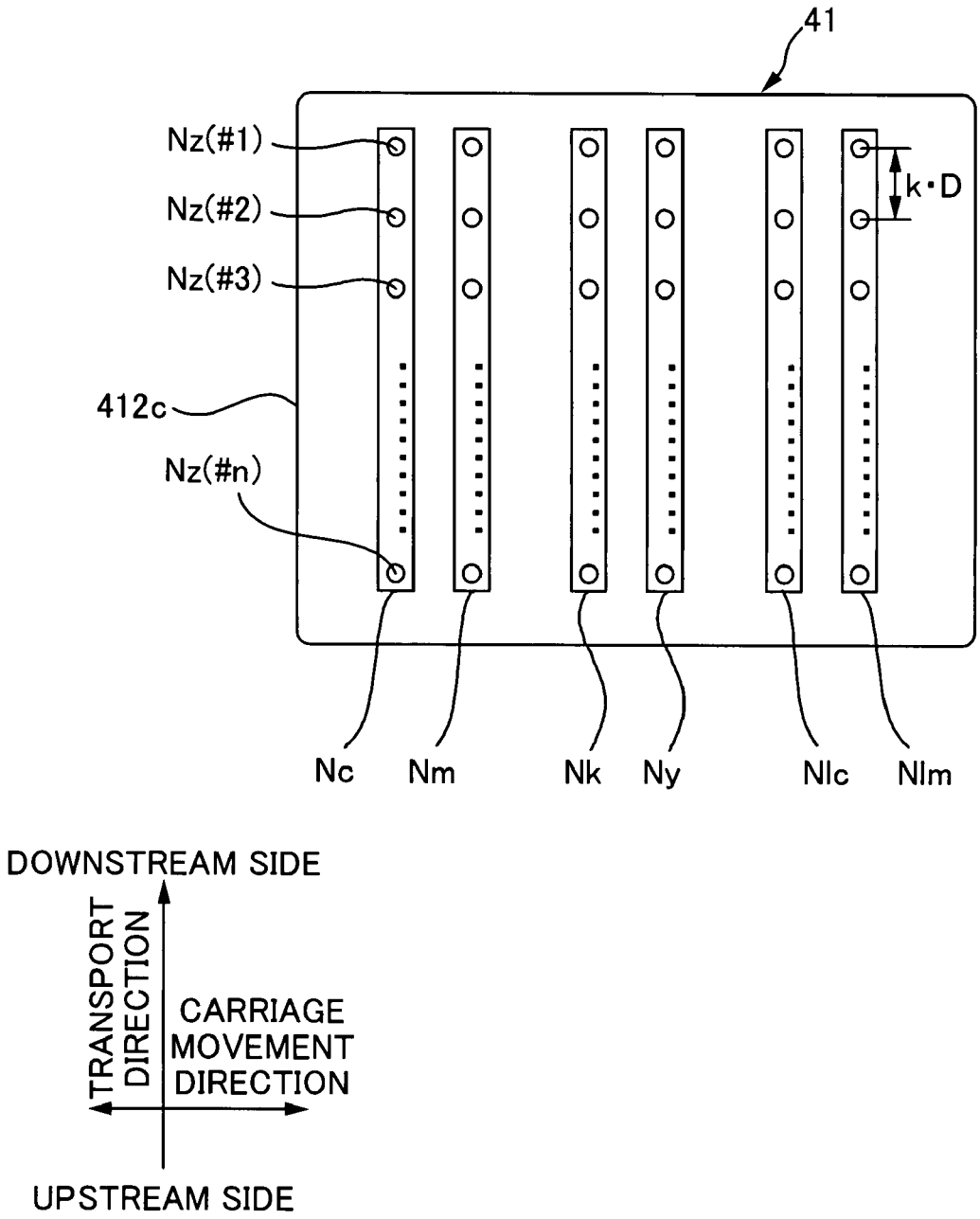
FIG. 5 is a diagram illustrating the arrangement of the nozzle rows.

The head unit 40 is for ejecting ink toward the paper S. The head unit 40 includes the head 41 and the head controller HC. The following is an explanation of the head unit 40. FIG. 4A is a cross-sectional view illustrating the structure of the head 41. FIG. 4B is a cross-sectional view showing, in magnification, the principal portions of the head 41. FIG. 5 is a diagram illustrating the arrangement of the nozzle rows.

Head 41

The head 41 includes a case 411, a channel unit 412, piezo element units 413, and a relay substrate 414. The case 411 is a block-shaped member in which accommodation chambers 411*a* for accommodating the piezo element units 413 are formed. One piezo element unit 413 is attached to each of the nozzle rows. As shown in FIG. 5, the head 41 includes six nozzle rows (Nk to Nlm). For this reason, the case 411 is provided with six accommodation chambers 411*a*, and each of the six piezo element units 413 is accommodated in its corresponding accommodation chamber 411*a*. It should be noted that FIG. 4A shows only a portion of the accommodation chambers 411*a*.

The channel unit 412 includes a channel forming plate 412*a*, an elastic plate 412*b* that is fixed to one surface of the channel forming plate 412*a*, and a nozzle plate 412*c* that is fixed to the other surface of the channel forming plate 412*a*. The channel forming plate 412*a* is made of a silicon wafer or a metal plate or the like. The channel forming plate 412*a* is provided with grooves serving as pressure chambers 412*d*, through holes serving as nozzle connection openings 412*e*, through holes serving as common ink chambers 412*f*, and grooves serving as ink supply paths 412*g*. The elastic plate 412*b* includes supporting frames 412*h* and islands 412*j* to which the front ends of the piezo elements PZT are fastened. Around the islands 412*j*, elastic regions made of an elastic membrane 412*i* are formed.

The piezo element units 413 each include a piezo element group 413*a*, a bonding substrate 413*b*, and an element wiring substrate 413*c*. The piezo element group 413*a* is comb-tooth-shaped, with each comb-tooth-shaped portion corresponding to a piezo element PZT. The piezo element group 413*a* includes a number of piezo elements PZT that corresponds to the number of nozzles Nz. Moreover, the bonding substrate 413*b* is a rectangular plate, the piezo element group 413*a* is adhered to one surface of the bonding substrate 413*b*, and the case 411 is adhered to the other surface of the bonding substrate 413*b*. The element wiring substrate 413*c* is a member for establishing an electrical connection between the relay substrate 414 and each of the piezo elements PZT. The head controllers HC are mounted on this element wiring substrate 413*c*.

The relay substrate 414 is a wiring substrate for establishing an electrical connection between the head controllers HC and the piezo elements PZT and between the driving signal generation section 50 and the printer-side controller 70. As noted above, the relay substrate 414 is connected to the element wiring substrate 413*c*. Moreover, the relay substrate 414 is also electrically connected with the flexible cable FC shown in FIG. 2. This flexible cable FC is for sending driving signals COM from the driving signal generation section 50 and head control signals from the printer-side controller 70.

The piezo elements PZT are deformed by applying a potential difference between opposing electrodes. In this example, they are expanded and contracted in their longitudinal direction. The amount of this expansion and contraction depends on the potential of the piezo elements PZT. Furthermore, the potential of the piezo elements PZT is set with applied portions in the driving signals COM (the portions indicated by solid lines in FIG. 14, FIG. 15A, and FIG. 15B). Consequently, the piezo elements PZT expand and contract in accordance with the potential that is imparted with the applied portions of the driving signals COM. When a piezo element PZT expands or contracts, the island 412*j* is pressed towards the pressure chamber 412*d* side or is pulled in the opposite direction. In this situation, the elastic membrane 412*i* around the island is deformed and ink can be ejected from the nozzle Nz with high efficiency. Such a piezo element PZT is an element that is charged and discharged with driving signals, and corresponds to an element performing the operation for ejecting ink. When the piezo elements PZT are used in the head 41, it is possible to control the amount and speed of the ejected ink to various values in accordance with the waveform of the applied driving pulses (for example first driving pulse PS1 to sixth driving pulse PS6, see FIG. 12). Moreover, it is possible to prevent a thickening of the ink through micro-oscillations of a meniscus (the free surface of the ink exposed at the nozzles Nz) without ejecting the ink.

The above-mentioned nozzle plate 412*c* is arranged on the surface of the head 41 that faces the paper. A plurality of nozzle rows made of a plurality of nozzles Nz are provided in the nozzle plate 412*c*. The nozzle rows correspond in number to the types of ink. For example, one nozzle row may be made up of n (for example 180) nozzles Nz lined up in the transport direction of the paper S, and such nozzle rows may be provided lined up in the carriage movement direction (head movement direction). As noted above the printer 1 is capable of ejecting six types of ink, so that six nozzle rows are provided. In the example shown in FIG. 5, a dark cyan ink nozzle row Nc, a dark magenta ink nozzle row Nm, a black ink nozzle row Nk, a yellow ink nozzle row Ny, a light cyan ink nozzle row Nlc and a light magenta ink nozzle row Nlm are provided in that order from the left side in the drawing in the head movement direction.

Here, nozzle rows ejecting ink used also in the high-speed mode (for convenience also referred to as "high-speed mode nozzle rows") are arranged at adjacent positions. In other words, no nozzle rows ejecting ink used only in the high-quality mode (for convenience also referred to as "high-quality mode nozzle rows") are arranged between the high-speed mode nozzle rows. As noted above, black ink, yellow ink, dark cyan ink and dark magenta ink are used in the high-speed mode. Therefore, the high-speed mode nozzle rows ejecting these inks are arranged in order from the edge in the head movement direction. For example, as shown in FIG. 5, the dark cyan ink nozzle row Nc is arranged at the left edge in the drawing, and the dark magenta ink nozzle row Nm is arranged next to it on the right. Moreover, on the right next to the dark magenta ink nozzle row Nm, the black ink nozzle row Nk is arranged, and the yellow ink nozzle row Ny is arranged to the right of that. On the other hand, the nozzle rows used exclusively in the high-quality mode are arranged next to the group of high-speed mode nozzle rows. In the example in FIG. 5, on the right next to the yellow ink nozzle row Ny, the light cyan ink nozzle row Nlc is arranged, and the light magenta ink nozzle row Nlm is arranged to the right of that.

The reason for this arrangement is to keep the movement range of the head 41 in the high-speed mode as short as possible. For example, when the head 41 in the example of FIG. 5 moves to the left, it is sufficient that the head 41 moves until the yellow ink nozzle row Ny reaches the left edge of the printing range. Conversely, when the head 41 moves to the right, it is sufficient that the head 41 moves until the dark cyan ink nozzle row Nc reaches the right edge of the printing range. For this reason, it is possible to shorten the movement range by a distance corresponding to two nozzle rows compared to a configuration in which one high-speed mode nozzle row is arranged at one end in the head movement direction and another high-speed mode nozzle row is arranged at the other end in the head movement direction. Accordingly, high-quality mode nozzle rows should not be arranged between neighboring high-speed mode nozzle rows. Therefore, the nozzle rows used exclusively for the high-quality mode may also be arranged at another location. For example, the light magenta ink nozzle row Nlm may also be arranged to the left of the dark cyan ink nozzle row Nc.

Head Controllers HC

Figure 6:
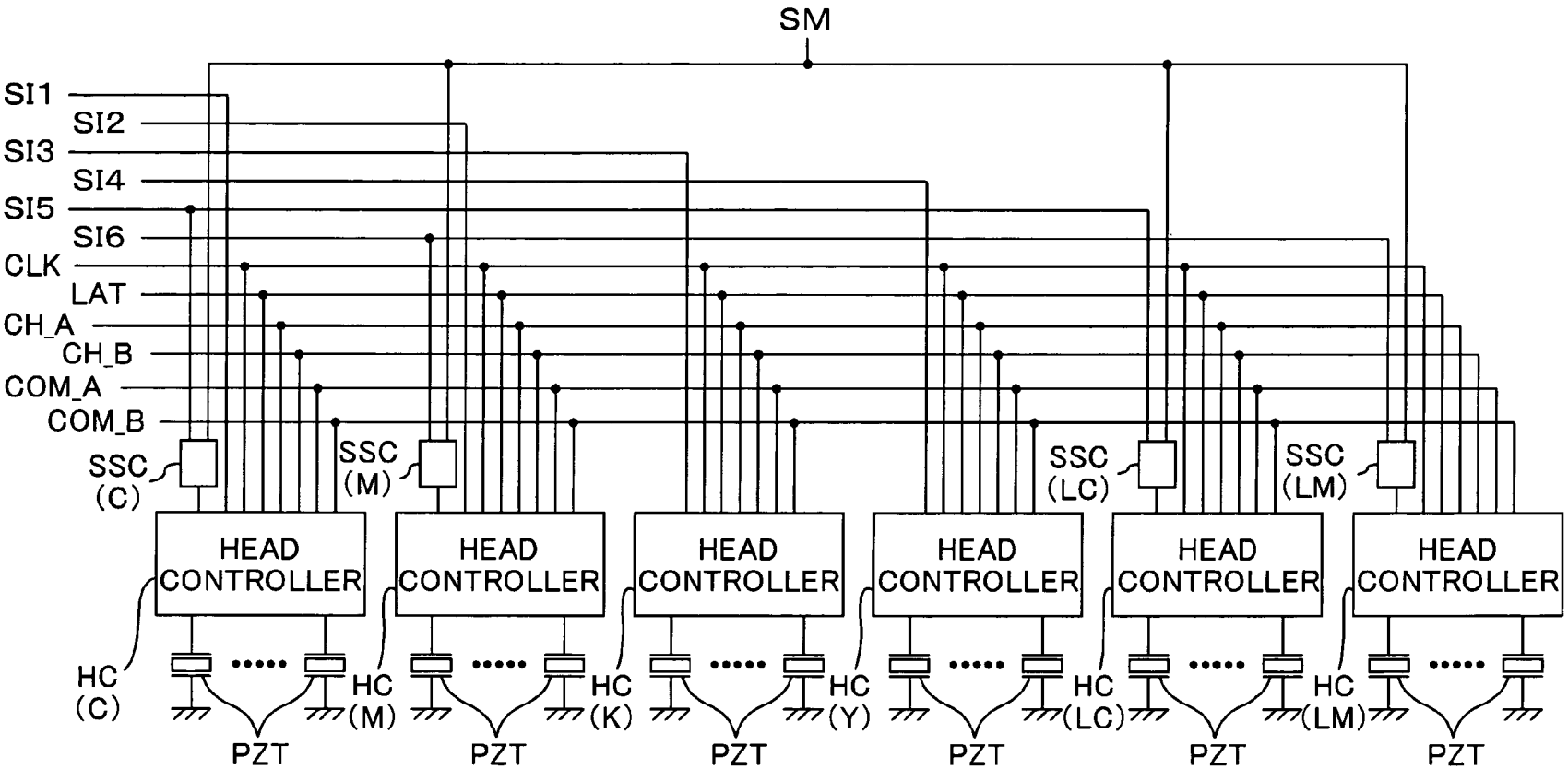
FIG. 6 is a drawing illustrating a plurality of head controllers of the head.

The head controllers HC are described next. Here, FIG. 6 is a drawing illustrating a plurality of the head controllers HC of the head 41. The following explanations also refer to FIG. 4A. The head 41 includes a plurality of head controllers HC. For example, as shown in FIG. 4A, each of the head controllers HC can be mounted to the element wiring substrate 413*c*. That is to say, a head controller HC is provided for each of the piezo element units 413. Moreover, in this head 41, a piezo element unit 413 is provided for each nozzle row. Therefore, a head controller HC is provided for each type of ink that is used. More specifically, as shown in FIG. 6, the head 41 includes a head controller HC (C) for dark cyan ink, a head controller HC (M) for dark magenta ink, a head controller HC (K) for black ink, a head controller HC (Y) for yellow ink, a head controller HC (LC) for light cyan ink, and a head controller HC (LM) for light magenta ink.

Figure 12:
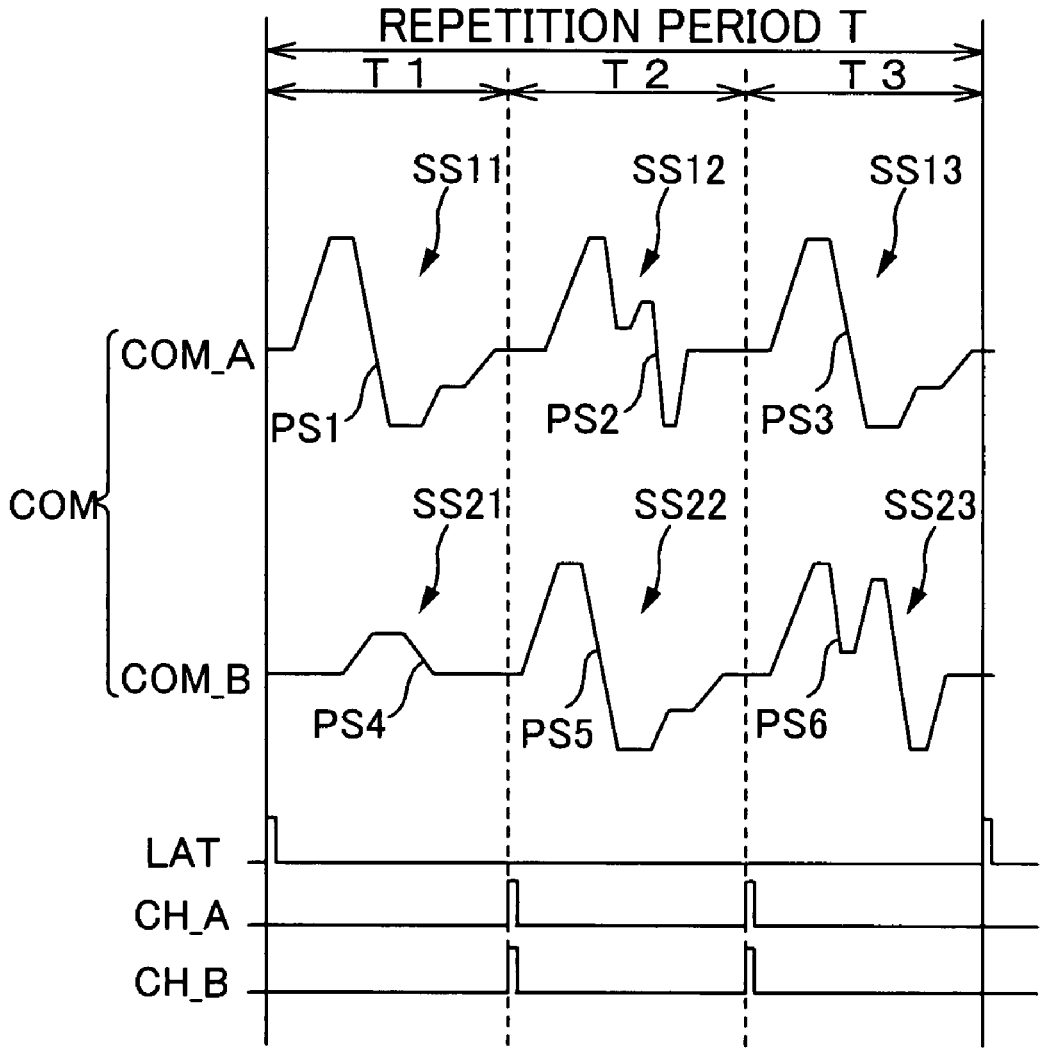
FIG. 12 is a diagram illustrating the driving signals generated by the driving signal generation section.

Based on the dot formation data SI1 to SI6 for the various kinds of ink, the head controllers HC (HC(C) to HC(LM)) apply the necessary portions of the driving signals COM (first driving signal COM_A and second driving signal COM_B, see FIG. 12) to the piezo elements PZT. Thus, ink is ejected from the corresponding nozzles Nz. The head controllers HC operating in this manner correspond to signal application sections that select the necessary portions from the driving signals COM and apply them to the piezo elements PZT, and constitute apart of the controller controlling the printing process. It should be noted that the configuration of these head controllers HC is explained later in more detail.

Driving Signal Generation Section 50

The driving signal generation section 50 generates the driving signals COM. As shown in FIG. 12, the driving signals COM include a first driving signal COM_A and a second driving signal COM_B. The first driving signal COM_A and the second driving signal COM_B are generated simultaneously for at least a dot formation period. Here, the dot formation period refers to the period in which the moving carriage CR opposes the print surface of the paper S, or in other words, the period during which the ink ejected from the nozzles Nz can land on the paper S. The dot formation period also corresponds to a "given period" in which a plurality of kinds of driving signals are generated simultaneously. Moreover, the first driving signal COM_A and the second driving signal COM_B are generated repeatedly at each repetition cycle T. This repetition cycle T can be divided into four periods T1 to T3. Accordingly, the first driving signal COM_A is made up of a first segment signal SS11 generated during the first period T1, a second segment signal SS12 generated during the second period T2, and a third segment signal SS13 generated during the third period T3. Moreover, the second driving signal COM_B is made up of a first segment signal SS21 generated during the first period T1, a second segment signal SS22 generated during the second period T2, and a third segment signal SS23 generated during the third period T3. The head controllers HC (HC(C) to HC(LM)) select the segment signals SS11 to SS23 in accordance with the content of the dot formation data SI (SI1 to SI6) and apply them to the piezo elements PZT. Therefore, the segment signals SS11 to SS23 correspond to the necessary portions applied to the piezo elements PZT. It should be noted that the first driving signal COM_A and the second driving signal COM_B are explained in more detail further below.

The Detector Group 60

The detector group 60 is for monitoring the state of the printer 1. As shown in FIG. 3A and FIG. 3B, this detector group 60 includes a linear encoder 61, a rotary encoder 62, a paper detector 63 and a paper width detector 64. The linear encoder 61 is for detecting the position of the carriage CR in the carriage movement direction. The rotary encoder 62 is for detecting the amount of rotation of the transport roller 23. The paper detector 63 is for detecting the printed paper S. The paper detector 64 is for detecting the width of the printed paper S.

The Printer-Side Controller 70

The printer-side controller 70 controls the various sections of the printer 1 in accordance with the print data that is sent from the host-side controller 111. For example, the printer-side controller 70 prints an image on the paper S by performing in alternation an operation of transporting the paper S by a predetermined transport amount and intermittently ejecting ink while moving the carriage CR (head 41). Therefore, the printer-side controller 70 controls the transporting of the paper S by controlling the rotation of the transport motor 22. Moreover, the printer-side controller 70 controls the movement of the carriage CR by controlling the rotation of the carriage motor 31. Furthermore, it performs the control for ejecting the ink by outputting the dot formation data SI to the head controllers HC. These kinds of control are performed based on the print mode, which is determined by the printer driver (host-side controller 111). For example, if the high-quality mode is set by the printer driver, the printer-side controller 70 outputs control signals that cause six types of ink to be ejected with four types of dot formation data SI (dot gradation values). On the other hand, if the high-speed mode has been set by the printer driver, the printer-side controller 70 outputs control signals that cause black ink and yellow ink to be ejected with four types of dot formation data SI and that cause dark cyan ink and magenta ink to be ejected with six types of dot formation data SI. Consequently, also the printer-side controller 70 constitutes a part of the controller controlling the printing process.

The printer-side controller 70 operating in this manner includes an interface section 71, a CPU 72, a memory 73, and a control unit 74, as shown for example in FIG. 2. The interface section 71 exchanges data with a computer 110 that is an external apparatus. The CPU 72 is an arithmetic processing device for carrying out the overall control of the printer 1. The memory 73 is for ensuring a working region and a region for storing the programs for the CPU 72, for instance, and is constituted by storage means such as a RAM, an EEPROM, or a ROM. The CPU 72 controls the various sections to be controlled in accordance with the computer programs stored in the memory 73. For example, the CPU 72 controls the paper transport mechanism 20 and the carriage movement mechanism 30 via the control unit 74. For example, it outputs control signals to the transport motor 22 or the carriage motor 31. Moreover, the CPU 72 outputs head control signals for controlling the operation of the head 41 (for example, a clock CLK, dot formation data SI, a latch signal LAT, a first change signal CH_A, a second change signal CH_B, see FIGS. 7A and 8) to the head controllers HC and outputs signal generation information for generating driving signals COM to the driving signal generation section 50.

Overall Operation of the Printing System 100

Here, the overall operation of the printing system 100 is explained. With the printing system 100 as explained above, it is possible to perform printing in a high-quality mode (corresponding to a first print mode) with six types of ink or a high-speed mode (corresponding to a second print mode) with four types of ink. Moreover, in the high-quality mode, the printer 1 uses black ink, yellow ink, dark cyan ink, light cyan ink, dark magenta ink, and light magenta ink, and ejects these inks with four types of dot formation data SI (corresponding to the predetermined number of types of dot gradation values). In the high-speed mode, the printer 1 uses black ink, yellow ink, dark cyan ink, and dark magenta ink, and ejects the black ink and the yellow ink with four types of dot formation data SI and ejects dark cyan ink and dark magenta ink with six types of dot formation data SI (corresponding to a number of dot gradation values that is greater than the predetermined number).

When such a configuration is adopted, the number of ink types that are used in the high-speed mode is smaller than in the high-quality mode. Accordingly, the load on the control with the printer driver (host-side controller 111) and the printer-side controller 70 is alleviated. As a result, faster processing is achieved. Moreover, in the high-speed mode, the number of dot gradation values for dark cyan ink and dark magenta ink is larger than the number of types of dot gradation values in the high-quality mode. With this configuration, it is possible to suppress a deterioration of image quality that is caused by the fact that fewer types of ink are used. That is to say, by increasing the number of dot gradation values, it is possible to precisely adjust the extent of changes in dark and light of dark cyan ink and dark magenta ink. Consequently, it is possible to print with higher image quality in the high-quality mode, and it is possible to print faster while suppressing a deterioration of image quality in the high-speed mode. By selecting these print modes, it is possible to achieve, at a high level, both faster printing and higher image quality.

Moreover, in the case that the high-quality mode is set, the printer driver switches from the high-quality mode to the high-speed mode when the amount of remaining light cyan ink or light magenta ink is below the reference amount. Thus, even when the remaining amount of at least one of light cyan ink and light magenta ink becomes low and it is time to exchange the cartridge, then it is possible to use the dark cyan ink and the dark magenta ink and to keep printing. For this reason, it is possible to delay the time for exchanging the ink cartridge IC, and to use the ink efficiently.

Detailed Explanation of the Head Controllers HC

Figure 7B:
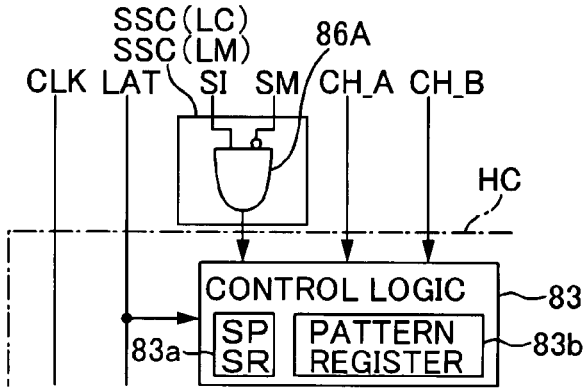
FIG. 7B is a diagram illustrating a signal selection section that is attached to the head controllers for light cyan ink and light magenta ink.

The following is a detailed explanation of the configuration for realizing such an operation. First, the head controllers HC are described in detail. FIG. 7A is a diagram illustrating a head controller HC of the type for four types of dot formation data SI. FIG. 7B is a diagram illustrating a signal selection section SSC (LC), SSC (LM) that is attached to the head controllers HC for light cyan ink and light magenta ink. FIG. 8 is a diagram illustrating a head controller HC of the type in which the dot formation data SI can be switched between four and six types. It should be noted that the following explanations also refer to FIG. 6. Moreover, for the sake of convenience, the head controller HC of the type for four types of dot formation data SI is also referred to as "head controller HC of the first type", and the head controller HC of the type in which the dot formation data SI can be switched between four and six types is also referred to as "head controller HC of the second type".

Head Controller HC of the First Type

First, a head controller HC of the first type is explained. The head controller HC of the first type is used for the head controllers HC controlling the ejection of ink with four types of dot formation data SI. In the head 41, it is used for the head controllers HC controlling the ejection of black ink, yellow ink, light cyan ink, and light magenta ink. As shown in FIG. 7A, the head controller HC of the first type includes a first shift register 81A, a second shift register 81B, a first latch circuit 82A, a second latch circuit 82B, a control logic 83, a decoder 84, a first switch 85A and a second switch 85B. Moreover, all parts except for the control logic 83, that is, the shift registers 81A and 81B, the latch circuits 82A and 82B, the decoder 84, the first switch 85A, and the second switch 85B are provided for each of the piezo elements PZT, that is, for each nozzle Nz.

Dot formation data SI from the printer-side controller 70 are set in the first shift register 81A and the second shift register 81B. The higher-order bits of the dot formation data SI are set in the first shift register 81A, and the lower-order bits of the dot formation data SI are set in the second shift register 81B. Here, the dot formation data SI is sent for each type of ink. As shown in FIG. 6, dot formation data SI3 is input into the head controller HC(K) for black ink, and dot formation data SI4 is input into the head controller HC(Y) for yellow ink. Moreover, dot formation data SI5 is input into the head controller HC(LC) for light cyan ink, and dot formation data SI6 is input into the head controller HC(LM) for light magenta ink.

The first latch circuit 82A and the second latch circuit 82B latch the dot formation data SI that is set in the first shift register 81A and the second shift register 81B. That is to say, the first latch circuit 82A latches the higher-order bits of the dot formation data SI set in the first shift register 81A, and the second latch circuit 82B latches the lower-order bits of the dot formation data SI set in the second shift register 81B. By latching with the first latch circuit 82A and the second latch circuit 82B, the dot formation data SI is grouped together for each nozzle Nz and input into the decoder 84.

The control logic 83 stores switch operation information (q0 to q3) determining the operation of the first switch 85A and switch operation information (q4 to q7) determining the operation of the second switch 85B. As explained above, the first switch 85A controls the application/non-application of the first driving signal COM_A to the piezo element PZT and the second switch 85B controls the application/non-application of the second driving signal COM_B to the piezo element PZT. The switch operation information q0 to q7 is also called "selection pattern data (SP data)" and is sent via the same signal line as the dot formation data SI. Therefore, the control logic 83 includes a shift register 83*a* (for convenience also referred to as SP shift register) in which the sent switch operation information q0 to q7 is set, and a pattern register 83*b*, which latches the switch operation information q0 to q7 set in the SP shift register 83*a* at a timing that is regulated by the latch signal LAT.

The pattern register 83*b* stores the switch operation information separately for each type of switch and for each type of dot formation data SI. In other words, it stores the switch operation information separately for each type of driving signal and for each type of dot formation data SI. Explaining this in more detail, for the first switch 85A, the pattern register 83*b* stores switch operation information q0 corresponding to non-formation of dots (data [00]), switch operation information q1 corresponding to the formation of small dots (data [01]), switch operation information q2 corresponding to the formation of medium dots (data [10]), and switch operation information q3 corresponding to the formation of large dots (data [11]). For the second switch 85B, it stores switch operation information q4 corresponding to non-formation of dots, switch operation information q5 corresponding to the formation of small dots, switch operation information q6 corresponding to the formation of medium dots, and switch operation information q7 corresponding to the formation of large dots.

The switch operation information q0 to q7 is output from the control logic 83. Moreover, the content of the switch operation information q0 to q7 is updated at a timing that is regulated by the latch signal LAT, a timing that is regulated by the first change signal CH_A, and a timing that is regulated by the second change signal CH_B.

The decoder 84 selects the switch operation information (q0 to q7) that is output from the control logic 83 in accordance with the dot formation data SI that is latched by the latch circuit 82, and outputs the selected switch operation information respectively to the first switch 85A and the second switch 85B. For example, if the dot formation data SI represents the non-formation of dots, then the switch operation information q0 is output to the first switch 85A and the switch operation information q4 is output to the second switch 85B. If the dot formation data SI represents the formation of small dots, then the switch operation information q1 is output to the first switch 85A and the switch operation information q5 is output to the second switch 85B. Similarly, if the dot formation data SI represents the formation of medium dots, then the switch operation information q2 is output to the first switch 85A and the switch operation information q6 is output to the second switch 85B, and if it represents the formation of large dots, then the switch operation information q3 is output to the first switch 85A and the switch operation information q7 is output to the second switch 85B.

Here, the switch operation information that is output from the control logic 83 is the information before being selected by the decoder 84. Therefore, it can also be expressed as pre-selection switch operation information. On the other hand, the switch operation information that is applied to the first switch 85A is the information that is selected by the decoder 84. For this reason, it corresponds to post-selection switch operation information. Consequently, the decoder 84 can be said to output, from the plurality types of pre-selection switch operation information that are output at the same time, the information corresponding to the dot formation data SI as the post-selection switch operation information. With this configuration, the information selected from a plurality of types of the pre-selection switch operation information is output as post-selection switch operation information, so that the processing can be sped up.

The first switch 85A is a switch operated with the switch operation information q0 to q3. This first switch 85A is arranged between a supply line for supplying the first driving signal COM_A and the piezo element PZT, applies the first driving signal COM_A to the piezo element PZT in the ON state, and shuts off the first driving signal COM_A in the OFF state. The second switch 85B is operated with switch operation information q4 to q7. This second switch 85B is arranged between a supply line for supplying the second driving signal COM_B and the piezo element PZT, applies the second driving signal COM_B to the piezo element PZT in the ON state, and shuts off the second driving signal COM_B in the OFF state. The switch operation information q0 to q7 is set such that there is no period of time in which both the first switch 85A and the second switch 85B are in the ON state. This is in order to protect the parts in the driving signal generation section 50 that generate the first driving signal COM_A and the parts that generate the second driving signal COM_B. That is to say, when the first switch 85A and the second switch 85B are both in the ON state, a through-current flows between these parts, and there is the danger that this adversely affects the circuit. With regard to this aspect, the switch operation information q0 to q7 is set such that only one of the first switch 85A and the second switch 85B is in the ON state, or such that both are in the OFF state.

Signal Selection Sections

The following is an explanation of the signal selection section SSC(LC) that is attached to the head controller HC(LC) for light cyan ink and the signal selection section SSC(LM) that is attached to the head controller HC(LM) for magenta ink. It should be noted that these signal selection sections SSC(LC) and SSC(LM) both have the same configuration.

As shown in FIG. 7B, the signal selection sections SSC (LC) and SSC(LM) include an AND-circuit 86A. This AND-circuit 86A corresponds to "another AND-circuit" and includes two input terminals and one output terminal. Moreover, the dot formation data SI is input into one of the input terminals. That is to say, the dot formation data SI5 for light cyan is input into the signal selection section SSC(LC) and the dot formation data SI6 for light magenta is input into the signal selection section SSC(LM). Mode specification data SM that has been inverted is input into the other input terminal. This mode specification data SM is data representing the specified print mode, which is [0] (low level, predetermined level) for the high-quality mode and [1] (high level, other predetermined level) for the high-speed mode. Consequently, if the high-quality mode is specified as the mode for printing, the output of the AND-circuit 86A becomes the same as the dot formation data SI. In this case, the higher-order bits of the dot formation data SI are set in the first shift register 81A, and the lower-order bits of the dot formation data SI are set in the second shift register 81B. Moreover, the switch operation information q0 to q7 is set in the SP shift register 83*a*. On the other hand, if the high-speed mode is specified as the mode for printing, the output of the AND-circuit 86A becomes [0] regardless of the dot formation data SI. In this case, [0] is set in each of the first shift register 81A, the second shift register 81B, and the SP shift register 83*a*. Consequently, if the high-speed mode is set, no ink is ejected from the nozzles Nz constituting the light cyan ink nozzle row Nlc and the nozzles Nz constituting the light magenta ink nozzle row Nlm. The AND-circuit 86A operating like this corresponds to a data invalidation section (more specifically "another data invalidation section") that invalidates the dot formation data SI in accordance with the content of the mode specification data SM. Moreover, with this AND-circuit 86A, it is possible to prevent an erroneous operation of the head controllers HC(LC) and HC(LM) in the high-speed mode.

Head Controller HC of the Second Type

In the following, a head controller HC of the second type is explained. This head controller HC of the second type is used for the head controllers HC controlling the ejection of ink by changing the four types with the six types of dot formation data SI. In the head 41, it is used for the head controllers HC(C) and HC(M) controlling the ejection of dark cyan ink and dark magenta ink. As shown in FIG. 8, the head controller HC of the second type includes a first shift register 81A, a second shift register 81B, a third shift register 81C, a first latch circuit 82A, a second latch circuit 82B, a third latch circuit 82C, a control logic 83, a decoder 84, a first switch 85A, and a second switch 85B. Also in the head controller HC of the second type, all parts except for the control logic 83, that is, the shift registers 81A to 81C, the latch circuits 82A to 82C, the decoder 84, the first switch 85A, and the second switch 85B are provided for each of the piezo elements PZT.

Dot formation data SI from the printer-side controller 70 are set in the first shift register 81A, the second shift register 81B, and the third shift register 81C. In the high-quality mode, the higher-order bits of the dot formation data SI are set in the first shift register 81A, and the lower-order bits of the dot formation data SI are set in the second shift register 81B. That is to say, as shown in FIG. 6, dot formation data SI1 is input into the head controller HC (C) for dark cyan ink, and dot formation data SI2 is input into the head controller HC(M) for dark magenta ink. In the high-quality mode, null data is set in the third shift register 81C for both head controllers HC(C) and HC(M).

In the high-speed mode on the other hand, the medium-order bits of the dot formation data SI are set in the first shift register 81A, and the lower-order bits of the dot formation data SI are set in the second shift register 81B. Moreover, the higher-order bits of the dot formation data SI are set in the third shift register 81C. In this case, as shown in FIG. 6, the dot formation data SI1 and the dot formation data SI5 is input into the head controller HC(C) for dark cyan ink, whereas the dot formation data SI2 and the dot formation data SI6 is input into the head controller HC(M) for dark magenta ink. That is to say, the dot formation data SI for dark cyan ink is constituted by the dot formation data SI1 and the dot formation data SI5. More specifically, the dot formation data SI1 becomes the medium-order bits and the lower-order bits in the dot formation data SI for dark cyan ink, which is respectively set in the first shift register 81A and the second shift register 81B. Moreover, the dot formation data SI5 becomes the higher-order bits in the dot formation data SI for dark cyan ink, and is set in the third shift register 81C. On the other hand, the dot formation data SI for dark magenta ink is constituted by the dot formation data SI2 and the dot formation data SI6. More specifically, the dot formation data SI2 becomes the medium-order bits and the lower-order bits in the dot formation data SI for dark magenta ink, which is respectively set in the first shift register 81A and the second shift register 81B. Moreover, the dot formation data SI6 becomes the higher-order bits in the dot formation data SI for dark magenta ink, and is set in the third shift register 81C.

The first latch circuit 82A, the second latch circuit 82B and the third latch circuit 82C latch the dot formation data SI that is set in the first shift register 81A, the second shift register 81B and the third shift register 81C. That is to say, the first latch circuit 82A latches the dot formation data SI that is set in the first shift register 81A. Moreover, the second latch circuit 82B latches the dot formation data SI that is set in the second shift register 81B, whereas the third latch circuit 82C latches the dot formation data SI that is set in the third shift register 81C. By latching with the first to third latch circuits 82A to 82C, the dot formation data SI is grouped together for each nozzle Nz and input into the decoder 84.

The control logic 83 stores switch operation information for determining the operation of the first switch 85A and switch operation information for determining the operation of the second switch 85B. Here, the types of switch operation information differ between the high-quality mode and the high-speed mode. That is to say, in the high-quality mode, there are four types of dot formation data SI, so that the switch operation information q0 to q3 is used for the first switch 85A, whereas the switch operation information q4 to q7 is used for the second switch 85B. Moreover, there is a total of eight types of switch operation information. On the other hand, in the high-speed mode, there are six types of dot formation data SI, so that the switch operation information q0 to q5 is used for the first switch 85A, whereas the switch operation information q6 to q11 is used for the second switch 85B. Moreover, there is a total of twelve types of switch operation information.

The switch operation information q0 to q7 or q0 to q11 is set in the SP shift register 83*a*. Here, in the high-speed mode, switch operation information q0 to q11 of a data amount that is larger than for the high-quality mode is set. For this reason, the SP shift registers 83*a* of the head controllers HC of the second type also include a region storing switch operation information that has been sent through the same signal lines as the dot formation data SI5 and SI6. Moreover, the pattern register 83*b* latches the switch operation information q0 to q7 or q0 to q11 that is set in the SP shift register 83*a* at a timing regulated by the latch signal LAT. The pattern register 83*b* stores the switch operation information separately for each type of switch and for each type of dot formation data SI. The switch operation information q0 to q7 stored for the high-quality mode is the same as for the head controllers HC of the first type, so that further explanations thereof are omitted. On the other hand, the switch operation information q0 to q11 that is stored for the high-speed mode is as explained in detail in the following. That is to say, for the first switch 85A, the pattern register 83*b* stores switch operation information q0 corresponding to non-formation of dots (data [000]), switch operation information q1 corresponding to the formation of first small dots (data [001]), switch operation information q2 corresponding to the formation of second small dots (data [100]), switch operation information q3 corresponding to the formation of first medium dots (data [010]), switch operation information q4 corresponding to the formation of second medium dots (data [101]), and switch operation information q5 corresponding to the formation of large dots (data [011]). Moreover, for the second switch 85B, it stores switch operation information q6 corresponding to the non-formation of dots, switch operation information q7 corresponding to the formation of first small dots, switch operation information q8 corresponding to the formation of second small dots, switch operation information q9 corresponding to the formation of first medium dots, switch operation information q10 corresponding to the formation of second medium dots, and switch operation information q11 corresponding to the formation of large dots.

The switch operation information q0 to q7 (for the high-quality mode) or q0 to q11 (for the high-speed mode) is output from the control logic 83. Moreover, the content of the switch operation information q0 to q7 or q0 to q11 is updated at a timing that is regulated by the latch signal LAT, a timing that is regulated by the first change signal CH_A, and a timing that is regulated by the second change signal CH_B.

The decoder 84 selects the switch operation information (q0 to q7, q0 to q11) that is output from the control logic 83 in accordance with the dot formation data SI that is latched by the latch circuit 82, and outputs the selected switch operation information respectively to the first switch 85A and the second switch 85B. Moreover, the first switch 85A is operated with the switch operation information q0 to q3 (for the high-quality mode) or q0 to q5 (for the high-speed mode), and controls the application of the first driving signal COM_A to the piezo element PZT. The second switch 85B is a switch operated with the switch operation information q4 to q7 (for the high-quality mode) or q6 to q11 (for the high-speed mode), and controls the application of the second driving signal COM_B to the piezo element PZT.

Signal Selection Sections

The following is an explanation of the signal selection sections SSC (C) and SSC (M) that are attached to the head controllers HC of the second type. It should be noted that these signal selection sections SSC(C) and SSC(M) both have the same configuration, and that both are constituted by an AND-circuit 86B. This AND-circuit 86B has two input terminals and one output terminal. The dot formation data SI is input into one of the input terminals. That is to say, the dot formation data SI5 is input into the signal selection section SSC(C) and the dot formation data SI6 is input into the signal selection section SSC (M). Mode specification data SM is input into the other input terminal. Consequently, if the high-quality mode is set as the print mode, the mode specification data SM is [0] (low level), so that [0] is output by the AND-circuit 86B regardless of the content of the dot formation data SI. In this case, as noted above, null data is set in the third shift register 81C. Consequently, also this AND-circuit 86B corresponds to a data invalidation section that invalidates the dot formation data SI in accordance with the content of the mode specification data SM. On the other hand, if the high-speed mode is set, the mode specification data SM becomes [1] (high level). Therefore, the output of the AND-circuit 86B becomes equal to the dot formation data SI. As a result, the higher-order bits of the dot formation data SI are set in the third shift register 81C.

Consequently, if the print mode is set to the high-quality mode, the data of the higher-order bits set in the first shift register 81A and the data of the lower-order bits set in the second shift register 81B is grouped together and input into the decoder 84. In this case, the null data set in the third shift register 81C is not used. Moreover, ink ejection control is performed with four types of dot formation data SI, based on two-bit dot formation data SI.

On the other hand, if the print mode is set to the high-speed mode, the data of the medium-order bits set in the first shift register 81A, the data of the lower-order bits set in the second shift register 81B, and the data of the higher-order bits set in the third shift register 81C is grouped together and input into the decoder 84. In this case, ink ejection control is performed with six types of dot formation data SI, based on three-bit dot formation data SI.

Printing Operation

Printing Operation

When printing an image on the paper S with the printing system 100 explained by way of example above, a process for generating the printing data and a process for printing on the paper S based on this print data are carried out. The process for generating the print data is performed by the computer 110 of the printing system 100. That is to say, the CPU 113 of the host-side controller 111 operates in accordance with a computer program (for example a printer driver) stored in the memory 114, and executes this process. Consequently, this computer program includes code for executing the various processes. The process for printing on the paper S is performed by the printer 1 of the printing system 100. That is to say, the CPU 72 of the printer-side controller 70 operates in accordance with a computer program stored in the memory 73, and executes this process. Consequently, this computer program includes code for executing the various processes.

The Process for Generating Print Data

Figure 9:
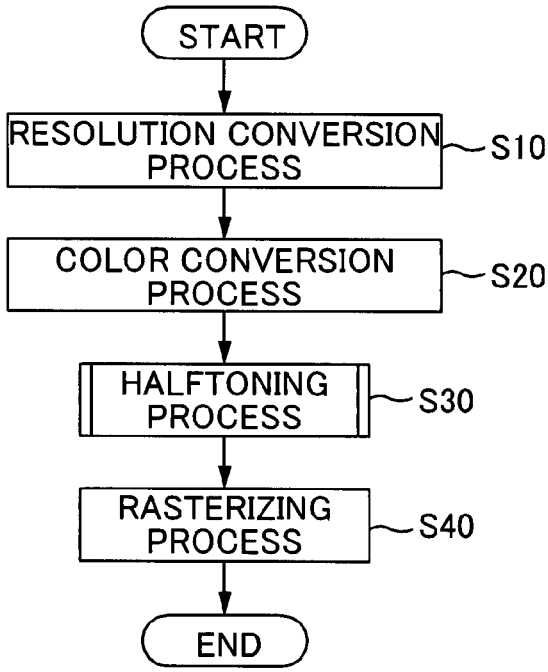
FIG. 9 is a flowchart illustrating the process for generating print data.

First, the process for generating print data is explained. FIG. 9 is a flowchart illustrating the process for generating print data. As shown in FIG. 9, in the process for generating print data, a resolution conversion process (S10), a color conversion process (S20), a halftoning process (S30) and a rasterizing process (S40) are carried out.

The resolution conversion process is a process for converting image data (text data, image data, etc.) to the resolution (the spacing of dots when printing; also referred to as "print resolution") for printing the image on the paper S. The color conversion process is a process for converting the RGB pixel data of RGB image data into data having gradation values of many levels (for example, print gradation values of 256 levels) expressed in CMYK color space. The color conversion process is carried out by looking up a table that correlates RGB gradation values and CMYK gradation values (color conversion lookup table), for example.

Figure 10:
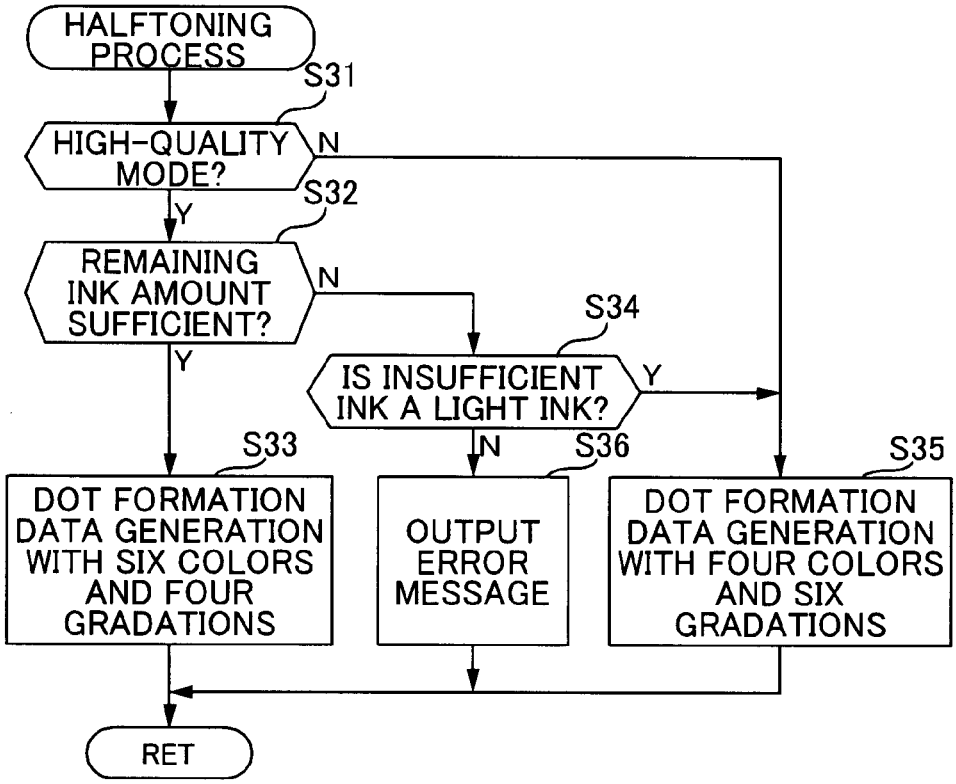
FIG. 10 is a flowchart illustrating the procedure of halftone processing.

The halftoning process is a process for converting CMYK pixel data having many gradation values into data of dot gradation values with fewer levels, which can be expressed by the printer 1. That is to say, it is a process for obtaining dot formation data SI from the CMYK pixel data having many levels of gradation values. Through this halftoning process, dot formation data SI of two-bit data or three-bit data (four types or six types of dot gradation values) is obtained from the CMYK pixel data representing 256 levels of gradation values, for example. Here, FIG. 10 is a flowchart illustrating the procedure of the halftoning process. As shown in FIG. 10, in the halftoning process, it is first judged whether the high-quality mode is set (S31). Then, if it is judged that the high-quality mode is set, it is judged whether the remaining ink amount is sufficient (S32). This judgment is performed by comparing the remaining ink amount to the reference amount. For example, if the remaining ink amount is equal to or greater than the reference amount, then it is judged that the remaining ink amount is sufficient, and if it is lower than the reference amount, it is judged that the remaining ink amount is not sufficient. This reference amount is set based on the remaining ink amount that will cause damage when printing. More specifically, it is set to an amount obtained by adding a predetermined margin to the remaining ink amount that will cause damage when printing. By setting the reference amount in this manner, it is possible to switch the print mode before damage is caused when printing. If it is judged that the remaining ink amount is sufficient, then four types of dot formation data SI are generated for the six types of ink (S33). That is to say, two-bit dot formation data SI is generated. Moreover, if the remaining ink amount is ink that is not sufficient at Step S32 (also referred to as "insufficient ink" in the following), then it is judged whether the insufficient ink is a light ink (S34). If the insufficient ink is a light ink or if it was judged at Step S31 that the high-quality mode is not set, then the high-speed mode is set. Then, dot formation data SI for four types of ink is generated (S35). More specifically, six types of dot formation data SI are generated for the dark cyan ink and the dark magenta ink. On the other hand, four types of dot formation data SI are generated for the black ink and the yellow ink. If it is judged at Step S34 that the insufficient ink is not a light ink, that is, if an ink other than the light cyan ink and the light magenta ink is insufficient, an error message is output (S36). In this case, the user is urged to exchange the ink cartridge IC, for example. As becomes clear from the foregoing explanations, the halftoning process can be said to be a process that restricts the print mode to a mode in which ink that is below the reference amount is not used if there is an ink whose remaining ink amount is lower than the reference amount. This configuration can prevent the empty ejection of ink and thus protects the piezo elements PZT.

The rasterization process is processing for changing the dot formation data SI that has been obtained by the halftoning process into the data order in which it is to be transferred to the printer 1. The rasterized dot formation data SI is output as print data to the printer 1 together with the above-mentioned command data.

The Processing for Printing on the Paper S

Figure 11:
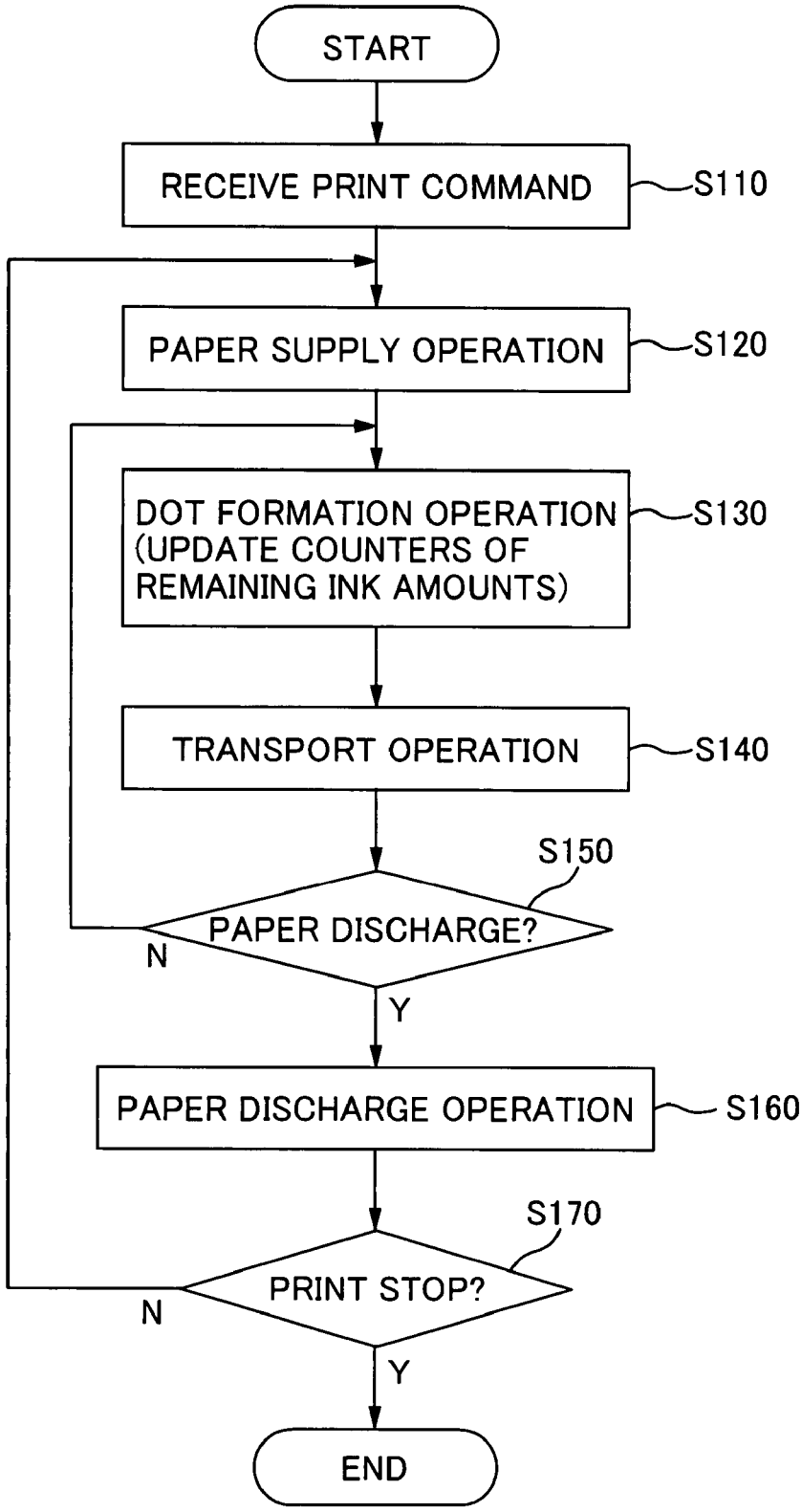
FIG. 11 is a flowchart illustrating the processing that is performed when printing.

The following is an explanation of the processing that is performed by the printer 1 to print on the paper S. Here, FIG. 11 is a flowchart illustrating the processing that is performed when printing. As shown in FIG. 11, in the processing for printing on the paper S, a print command receiving operation (S110), a paper supply operation (S120), a dot formation operation (S130), a transport operation (S140), a paper discharge judgment (S150), a paper discharge operation (S160) and a print stop judgment (S170) are carried out.

In the print command receiving operation, the printer-side controller 70 receives a print command via the interface section 71 from the computer 110. This print command is included in the print data transmitted from the computer 110. The paper supply operation is an operation for moving the paper S, which is the medium to be printed, and positioning it at a print start position (the so-called indexing position). In this paper supply operation, the printer-side controller 70 rotates the paper supply roller 21 and feeds the paper S to be printed up to the transport roller 23. Next, the printer-side controller 70 rotates the transport roller 23 and positions the paper S, that has been fed from the paper supply roller 21, at the print start position. The dot formation operation is an operation for intermittently ejecting ink from the head 41 moving in the carriage movement direction, and forming dots on the paper S. The printer-side controller 70 drives the carriage motor 31 to move the carriage CR in the carriage movement direction. The printer-side controller 70 causes ink to be ejected from the head 41 (nozzles Nz) in accordance with the dot formation data SI while the carriage CR is moving. Then, as mentioned above, if ink that is ejected from the head 41 lands on the paper S, dots are formed on the paper S. A detailed description of the dot formation operation is provided later. The transport operation is an operation for moving the paper S relative to the head 41 in the transport direction. The printer-side controller 70 rotates the transport roller 23 and transports the paper S in the transport direction. Through this transport operation, the head 41 is able to form dots at positions that are different from the positions of the dots formed in the preceding dot formation operation. The paper discharge judgment is a process for judging whether or not to discharge the paper S being printed. This judgment is performed based on whether there is print data left. That is to say, the printer-side controller 70 judges whether there is print data left for the paper S being printed and if there is print data left, it is judged that the paper is not discharged. In this case, the printer-side controller 70 repeats in alternation the dot formation operation and the transport operation until there is no longer any print data, gradually printing an image made of dots on the paper S. If there is no more print data left, the printer-side controller 70 judges that the paper is to be discharged and discharges the printed paper S to the outside by rotating the paper discharge roller 25. It should be noted that whether or not to discharge the paper can also be determined based on a paper discharge command that is included in the print data. The print stop judgment is for judging whether or not the printing is to be continued. In this judgment, the printer-side controller 70 judges whether there is print data left. If the printing of the next paper S is to be carried out, the paper supply operation for the next paper S is performed. On the other hand, if the next sheet of paper S is not to be printed, then the printing operation is terminated.

The Dot Formation Operation

Figure 14:
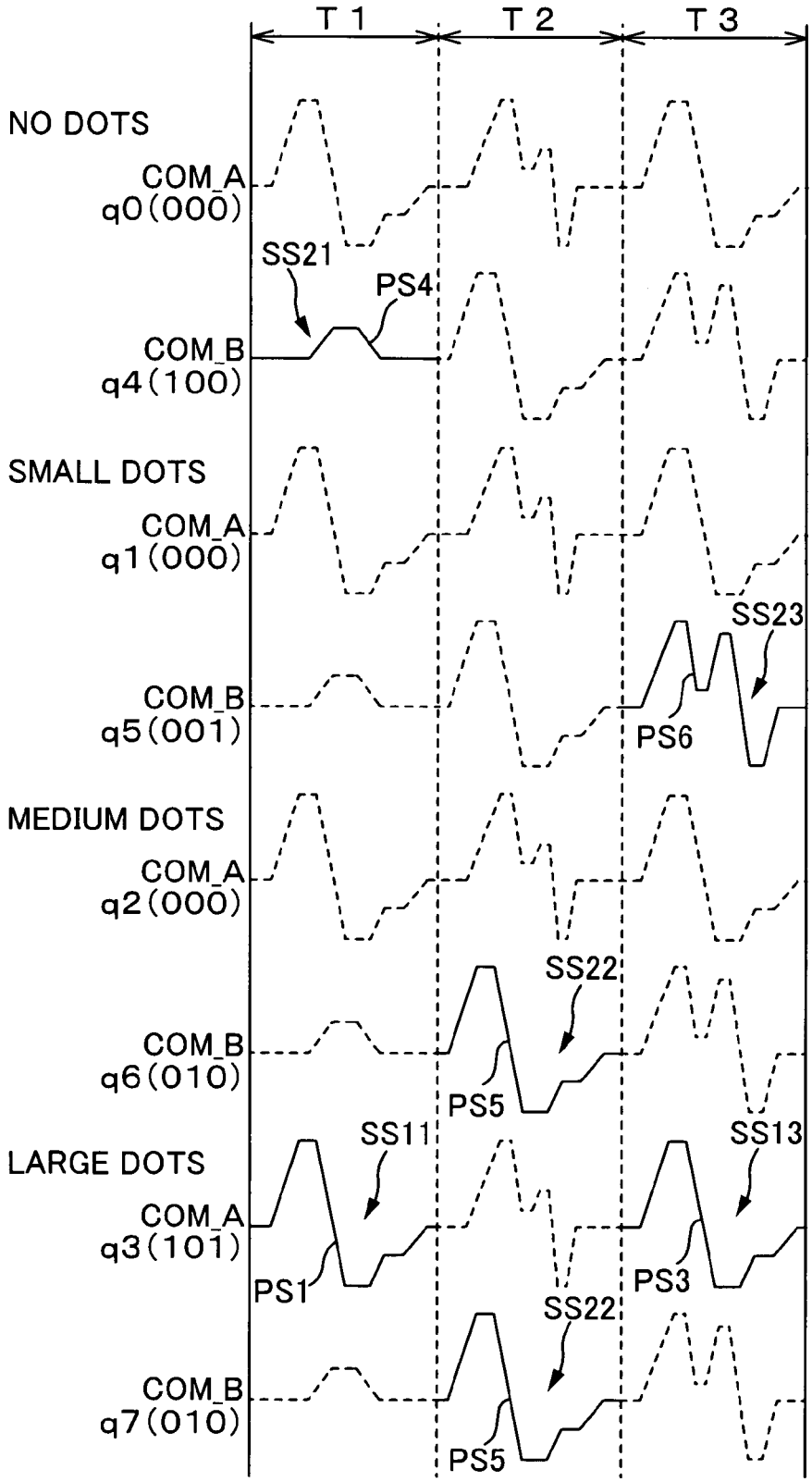
FIG. 14 is a diagram illustrating, for each type of dots, the segment signals of the driving signal applied for black ink and yellow ink in the high-quality mode and the high-speed mode.
Figure 15:
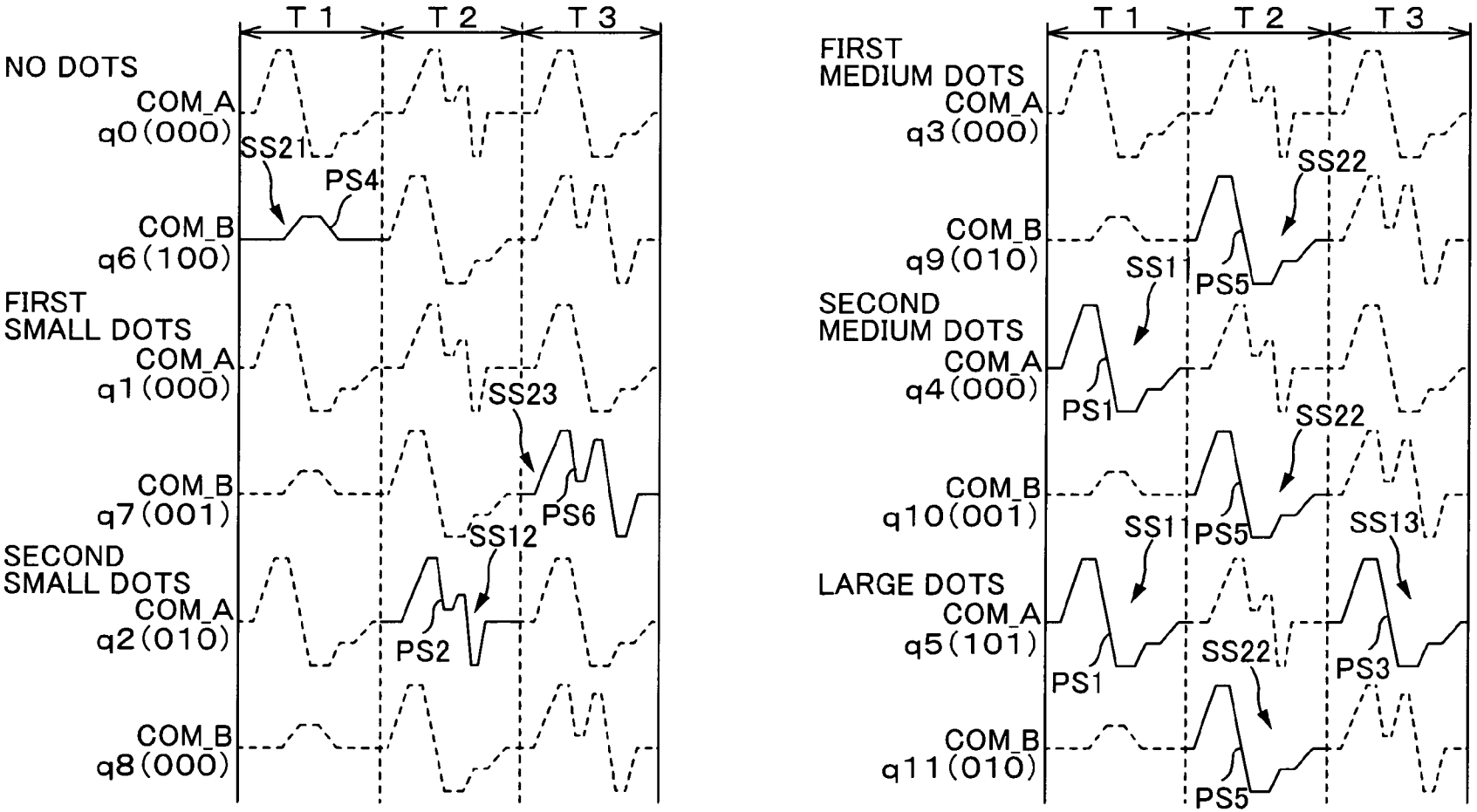
FIG. 15 is a diagram illustrating, for each type of dots individually, the segment signals of the driving signal applied for dark cyan ink and dark magenta ink in the high-speed mode.

The following is a detailed explanation of the dot formation operation (S130). Here, FIG. 12 is a drawing illustrating the driving signals COM (first driving signal COM_A and second driving signal COM_B) generated by the driving signal generation section 50. FIG. 13A is a diagram illustrating the driving pulses applied to the piezo elements PZT and the amount of ink ejected in the high-quality mode for each type of ink and for each dot formation data SI. FIG. 13B is a diagram illustrating the driving pulses applied to the piezo elements PZT and the amount of ink ejected in the high-speed mode for each type of ink and for each dot formation data SI. FIG. 14 is a diagram illustrating the segment signals of the driving signals COM applied for black ink and yellow ink in the high-quality mode and the high-quality mode for each type of dot. FIG. 15 is a diagram illustrating the segment signals of the driving signal applied for dark cyan ink and dark magenta ink in the high-speed mode for each ink type.

In this dot formation operation, the host-side controller 111 (printer driver) generates the dot formation data SI. As the dot formation data SI is generated, the host-side controller 111 counts the number of ink ejections. Thus, the amount of remaining ink is updated. On the other hand, the printer-side controller 70 outputs a DAC value to the driving signal generation section 50 and the driving signal generation section 50 outputs a voltage signal corresponding to the DAC value to the head unit 40. That is to say, the driving signal generation section 50 generates a driving signal COM of the voltage regulated by the DAC value. The generation of this driving signal COM is repeated each time the latch signal LAT becomes high level. As a result, the driving signals COM shown in FIG. 12, that is, the first driving signal COM_A and the second driving signal COM_B are generated repeatedly at each repetition period T. As mentioned above, the first driving signal COM_A is made up of a first segment signal SS11 generated during the first period T1, a second segment signal SS12 generated during the second period T2, and a third segment signal SS13 generated during the third period T3. Moreover, the second driving signal COM_B is made up of a first segment signal SS21 generated during the first period T1, a second segment signal SS22 generated during the second period T2, and a third segment signal SS23 generated during the third period T3. The first segment signal SS11 of the first driving signal COM_A includes a first driving pulse PS1. The second segment signal SS12 includes a second driving pulse PS2, and the third segment signal SS13 includes a third driving pulse PS3. Similarly, the first segment signal SS21 of the second driving signal COM_B includes a fourth driving pulse PS4, the second segment signal SS22 includes a fifth driving pulse PS5, and the third segment signal SS23 includes a sixth driving pulse PS6.

These driving pulses PS1 to PS6 correspond to waveform portions for driving the piezo elements PZT to perform the desired operation. In the present embodiment, the piezo elements PZT are expanded and contracted by applying these driving pulses PS1 to PS6, thus displacing the islands 412*j*. Moreover, among these driving pulses PS1 to PS6, the driving pulses PS1, PS3, and PS5 all have the same waveform, and when one of these driving pulses is applied to a piezo element PZT, it causes about 7 pL ink to be ejected. When the second driving pulse PS2 is applied to the piezo element PZT, about 2.5 pL ink is ejected, and when the sixth driving pulse PS6 is applied to the piezo element PZT, about 1.6 pL ink is ejected. When the fourth driving pulse PS4 is applied to the piezo element PZT, a pressure variation that is so weak that no ink is ejected acts on the ink inside the pressure chamber 412*d*, and the meniscus performs a micro-oscillation.

Next, the operation of applying the necessary portion of the driving signals COM to the piezo element PZT, based on the switch operation information, is explained. There are four types of dot formation data SI in the high-quality mode, corresponding to no dots, formation of small dots, formation of medium dots and formation of large dots. Moreover, the switch operation information q0 to q7 is set as follows. The switch operation information q0 corresponding to the dot formation data SI for no dots is the data [000] and the switch operation information q4 is the data [100]. The switch operation information q1 corresponding to the dot formation data SI for small dots is the data [000] and the switch operation information q5 is the data [001]. The switch operation information q2 corresponding to the dot formation data SI for medium dots is the data [000], and the switch operation information q6 is the data [010]. And the switch operation information q3 corresponding to the dot formation data SI for large dots is the data [101], and the switch operation information q7 is the data [010].

On the other hand, there are four types of dot formation data SI in the high-speed mode, corresponding to no dots, formation of small dots, formation of medium dots and formation of large dots for black ink and for yellow ink. In this case, the switch operation information is the same as for the case of the high-quality mode. Therefore, further explanations thereof are omitted. Moreover, for dark cyan ink and for dark magenta ink, there are six types, namely for no dots, for the formation of first small dots, for the formation of second small dots, for the formation of first medium dots, for the formation of second medium dots, and for the formation of large dots. In this case, the switch operation information q0 to q11 is set as follows. That is, the switch operation information q0 corresponding to the dot formation data SI for no dots is the data [000], and the switch operation information q6 is the data [100]. The switch operation information q1 corresponding to the dot formation data SI for first small dots is the data [000] and the switch operation information q7 is the data [001]. The switch operation information q2 corresponding to the dot formation data SI for second small dots is the data [010], and the switch operation information q8 is the data [000]. The switch operation information q3 corresponding to the dot formation data SI for first medium dots is the data [000], and the switch operation information q9 is the data [010]. The switch operation information q4 corresponding to the dot formation data SI for second medium dots is the data [100], and the switch operation information q10 is the data [010]. And the switch operation information q5 corresponding to the dot formation data SI for large dots is the data [101], and the switch operation information q11 is the data [010].

Thus, for black ink and yellow ink in the high-quality mode and the high-speed mode, the segment signals SS11 to SS23 are applied to the piezo element PZT with the patterns shown in FIG. 14. That is to say, when no dots are formed, the first segment signal SS21 of the second driving signal COM_B is applied to the piezo element PZT. Then, the meniscus performs a micro-oscillation due to the fourth driving pulse PS4 included in the first segment signal SS21. In the formation of small dots, the third segment signal SS23 (sixth driving pulse PS6) of the second driving signal COM_B is applied to the piezo element PZT, and about 1.6 pL ink is ejected. In the formation of medium dots, the second segment signal SS22 (fifth driving pulse PS5) of the second driving signal COM_B is applied to the piezo element PZT, and about 7 pL ink is ejected. In the formation of large dots, the first segment signal SS11 (first driving pulse PS1) and the third segment signal SS13 (third driving pulses PS3) of the first driving signal COM_A and the second segment signal SS22 (fifth driving pulse PS5) of the second driving signal COM_B are applied to the piezo element PZT, and about 21 pL ink is ejected.

On the other hand, for dark cyan ink and dark magenta ink in the high-speed mode, the segment signals SS11 to SS23 are applied to the piezo element PZT with the patterns shown in FIG. 15. That is to say, when no dots are formed, the first segment signal SS21 of the second driving signal COM_B (fourth driving pulse PS4) is applied to the piezo element PZT, and the meniscus performs a micro-oscillation. In the formation of first small dots, the third segment signal SS23 (sixth driving pulse PS6) of the second driving signal COM_B is applied to the piezo element PZT, and about 1.6 pL ink is ejected. In the formation of second small dots, the second segment signal SS12 (second driving pulse PS2) of the first driving signal COM_A is applied to the piezo element PZT, and about 2.5 pL ink is ejected. In the formation of first medium dots, the second segment signal SS22 (fifth driving pulse PS5) of the second driving signal COM_B is applied to the piezo element PZT, and about 7 pL ink is ejected. In the formation of second medium dots, the first segment signal SS11 (first driving pulse PS1) of the first driving signal COM_A and the second segment signal SS22 (fifth driving pulse PS5) of the second driving signal COM_B are applied to the piezo element PZT, and about 14 pL ink is ejected. In the formation of large dots, the first segment signal SS11 (first driving pulse PS1) and the third segment signal SS13 (third driving pulse PS3) of the first driving signal COM_A and the second segment signal SS22 (fifth driving pulse PS5) of the second driving signal COM_B are applied to the piezo element PZT, and about 21 pL ink is ejected.

Thus, with the printer 1 of the present embodiment, printing is carried out in the set print mode, that is, a high-quality mode in which both dark cyan ink and dark magenta ink as well as light cyan ink and light magenta ink are used and printing is performed with four types of dot formation data SI or a high-speed mode in which dark cyan ink and dark magenta ink are used and printing is performed with six types of dot formation data SI. In the high-speed mode, fewer types of ink are used than in the high-quality mode, so that the load on the control can be reduced and speedier processing can be achieved. Moreover, in the high-speed mode, the number of types of dot formation data SI for dark ink (dark cyan ink and dark magenta ink) is set to a larger number than in the high-quality mode (high-resolution mode), so that a deterioration of the image quality caused by the fact that fewer types of ink are used can be suppressed. That is to say, it is possible to print with higher image quality in the high-quality mode, and it is possible to print faster while suppressing a deterioration of image quality in the high-speed mode. By selecting these print modes, it is possible to achieve, at a high level, both faster printing and higher image quality.

With this printing system 100, when the high-quality mode has been set as the print mode, if the printer driver judges that the remaining amount of ink for at least one of light cyan ink and light magenta ink is insufficient, then the print mode is switched to the high-speed mode. In this situation, printing is performed using four types of ink, namely dark cyan ink, dark magenta ink, black ink, and yellow ink. Thus, even when a light ink (light cyan ink, light magenta ink) is insufficient, printing can be continued using a dark ink, and the ink can be used efficiently. Moreover, in this case, the number of types of dot formation data SI for dark ink is larger than in the high-quality mode. In particular, with this printing system 100, the difference of the ink amount between a given dot gradation value and the next dot gradation value in the high-speed mode is lower than the difference of the ink amount between a given dot gradation value and the next dot gradation value in the high-quality mode. To explain this in more detail, the difference in the ink amount between the formation of first small dots and the formation of second small dots in the high-speed mode is about 0.9 pL, whereas the difference in the ink amount between the formation of small dots and the formation of medium dots in the high-quality mode is about 5.4 pL. It should be noted that the same amount of ink is ejected for the formation of first small dots in the high-speed mode as for the formation of small dots in the high-quality mode. Moreover, the difference in the ink amount between the formation of first medium dots and the formation of second medium dots in the high-speed mode is about 7 pL, whereas the difference in the ink amount between the formation of medium dots and the formation of large dots in the high-quality mode is about 14 pL. Also here, the same amount of ink is ejected for the formation of first medium dots in the high-speed mode as for the formation of medium dots in the high-quality mode. Furthermore, ink ejected for the formation of large dots, is the same amount of ink ejected in the high-quality mode as in the high-speed mode. Thus, regarding cyan and magenta, the level of change between dark and light for dark ink in the high-speed mode can be adjusted more precisely than the level of change between dark and light for dark ink in the high-quality mode. Thus, it is possible to suppress a deterioration of image quality caused by the fact that no light ink is used.

Furthermore, when the high-speed mode is specified for one of cyan and magenta, the high-speed mode is also specified for the other. Thus, problems caused by differences in the print mode, such as the problem that the color balance between cyan and magenta is destroyed, can be prevented.

Second Embodiment

In the above-described first embodiment, printing was continued using a dark ink (dark cyan ink, dark magenta ink) if a light ink (light cyan ink, light magenta ink) became insufficient. However, there is no limitation to this configuration. For example, it is also possible to perform printing using a light ink instead of a dark ink. A second embodiment with such a configuration is described next.

Overview of Second Embodiment

The hardware configuration of this second embodiment is the same as that of the first embodiment. For this reason, further explanations regarding the hardware configuration are omitted, and an outline of the operation is explained. Also with this second printing system 100, it is possible to perform printing in a high-quality mode (corresponding to a first print mode) with six types of ink or a high-speed mode (corresponding to a second print mode) with four types of ink. Here, the inks used in the high-quality mode are the same as in the first embodiment. On the other hand, as the high-speed mode, a first high-speed mode using black ink, yellow ink, dark cyan ink, and dark magenta ink as well as a second high-speed mode using black ink, yellow ink, light cyan ink, and light magenta ink are provided. In the first high-speed mode, black ink and yellow ink are ejected with four types of dot formation data SI, whereas dark cyan ink and dark magenta ink are ejected with six types of dot formation data SI (corresponding to the number of types of dot gradation values greater than a predetermined number). Like in the high-speed mode of the above-explained first embodiment, the difference in the ink amounts of a given dot gradation value and the next dot gradation value in the first high-speed mode is smaller than the difference in the ink amounts of a given dot gradation value and the next dot gradation value in the high-quality mode. Moreover, in the second high-speed mode, black ink and yellow ink is ejected with four types of dot formation data SI, whereas light cyan ink and light magenta ink is ejected with six types of dot formation data SI.

Halftoning Process

Figure 16:
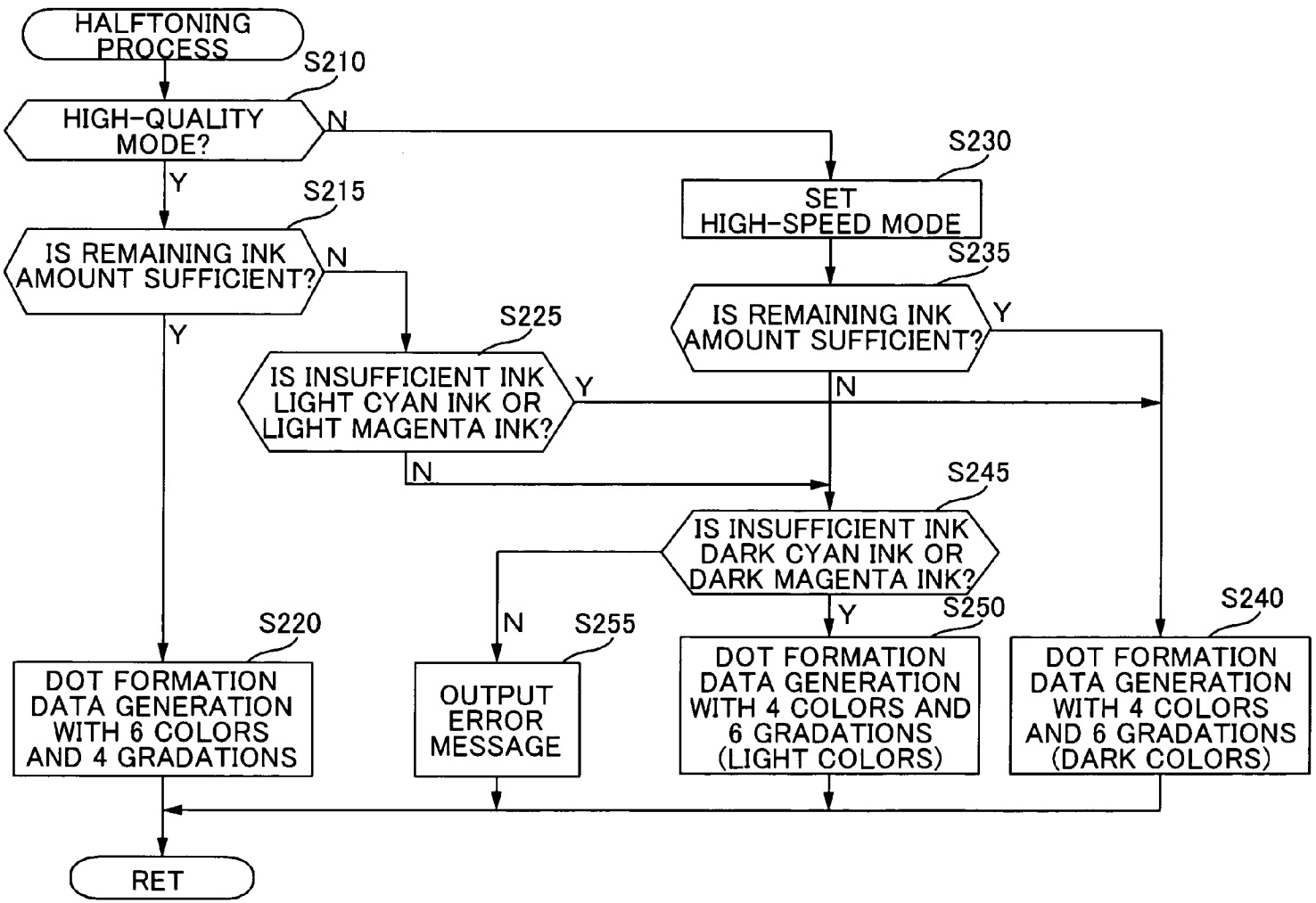
FIG. 16 is a flowchart illustrating the halftone processing in the second embodiment.

The following is an explanation of the halftoning process. FIG. 16 is a flowchart illustrating the halftoning process in the second embodiment. As shown in FIG. 16, in the halftoning process, it is first judged whether or not the high-quality mode has been set (S210). Then, if it is judged that the high-quality mode is set, it is judged whether or not the remaining ink amount is sufficient (S215). Here, if it is judged that the remaining ink amount is sufficient, then four types of dot formation data SI are generated for the six types of ink (S220). That is to say, two-bit dot formation data SI is generated. If it is judged at Step S215 that there is insufficient ink, then it is judged whether or not this insufficient ink is a light ink (S225). Here, if the insufficient ink is a light ink, the first high-speed mode is set, and dot formation data SI is generated for four types of ink, namely dark cyan ink, dark magenta ink, black ink, and yellow ink (S240). More specifically, six types of dot formation data SI are generated for the dark cyan ink and the dark magenta ink. On the other hand, four types of dot formation data SI are generated for the black ink and the yellow ink. Moreover, if it is judged in Step S210 that the high-quality mode has not been set, then the first high-speed mode is set (S230). Then, it is judged whether or not the amount of remaining ink is sufficient (S235). Here, the amount of remaining ink is judged for dark cyan ink, dark magenta ink, black ink, and yellow ink, and if it is judged that the amount of remaining ink is sufficient, then the dot formation data SI is generated for these inks (S240). If it is judged at Step S225 that the insufficient ink is not a light ink, or if it is judged at Step S235 that there is an insufficient ink, then it is judged whether or not the insufficient ink is a dark ink (dark cyan ink, dark magenta ink) (S245). Here, if the insufficient ink is a dark ink, the second high-speed mode is set, and dot formation data SI is generated for four types of ink, namely light cyan ink, light magenta ink, black ink, and yellow ink (S250). More specifically, six types of dot formation data SI are generated for the light cyan ink and the light magenta ink. On the other hand, four types of dot formation data SI are generated for the black ink and the yellow ink. If it is judged at Step S245 that the insufficient ink is not a dark ink, that is, if black ink or magenta ink is insufficient, an error message is output (S255). In this case, the user is urged to exchange the ink cartridge IC, for example.

The Dot Formation Operation

Figure 17:
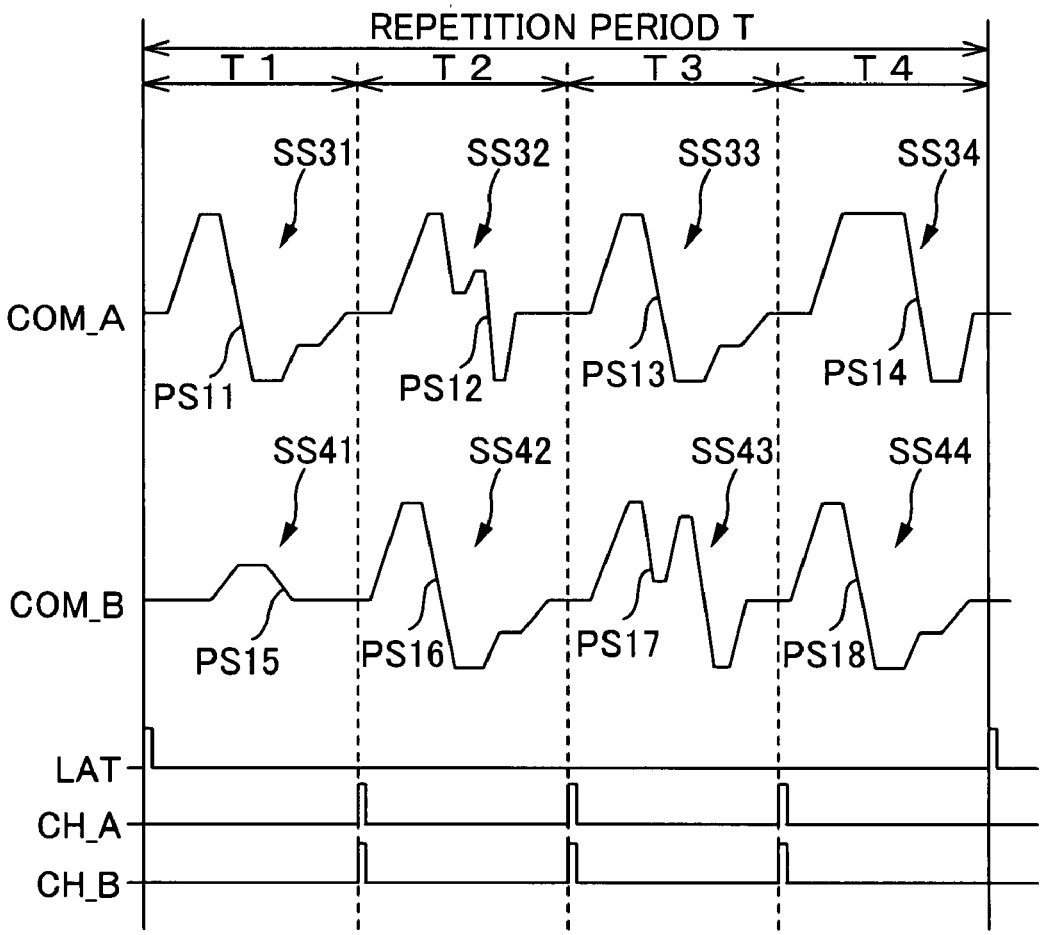
FIG. 17 is a diagram illustrating the driving signals generated by the driving signal generation section in the second embodiment.
Figure 19:
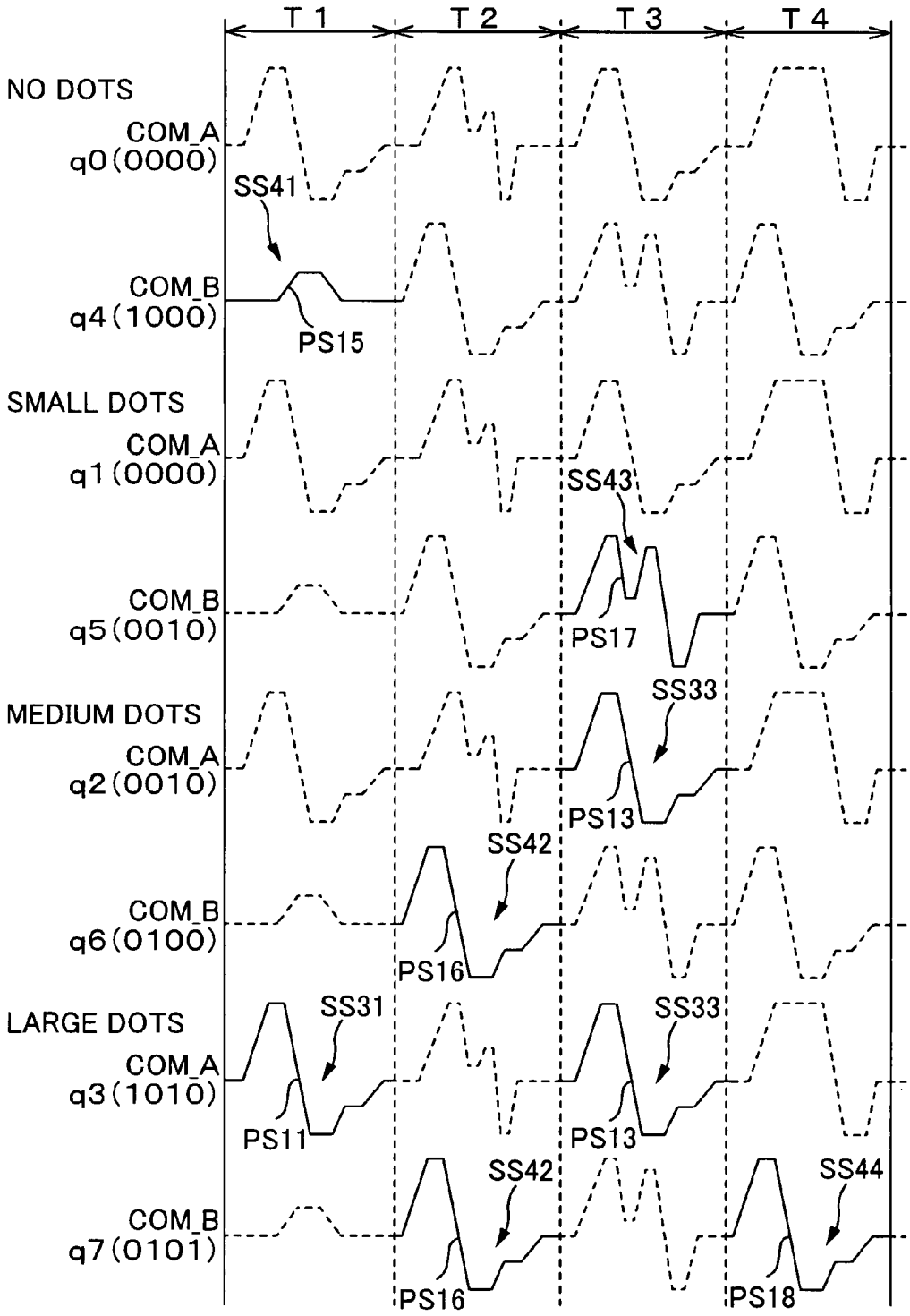
FIG. 19 is a diagram illustrating, for each type of dots, the segment signals of the driving signal applied for black ink and yellow ink in the high-quality mode and the high-speed mode.
Figure 20:
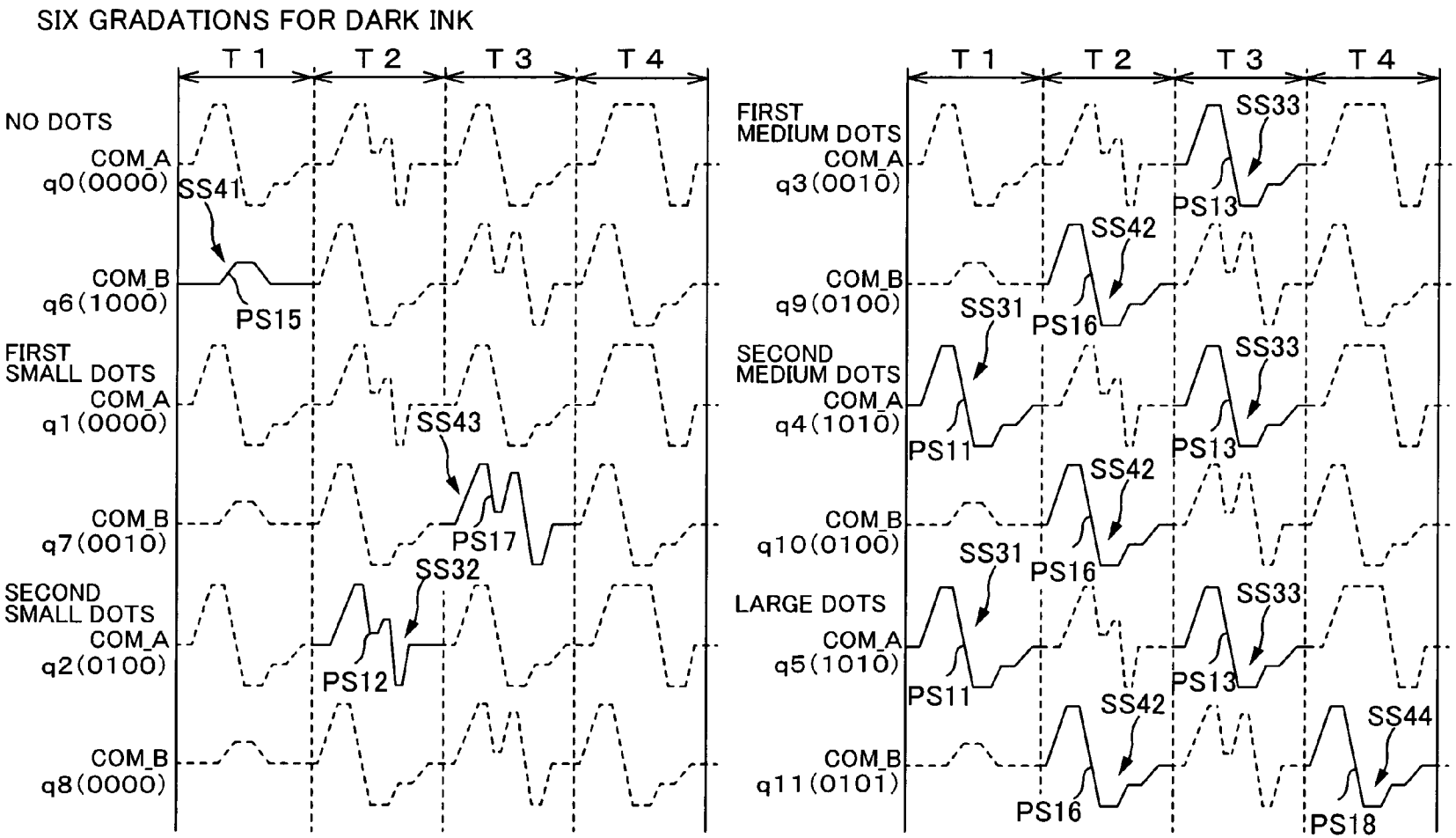
FIG. 20 is a diagram illustrating, for each type of dots, the segment signals of the driving signal applied for dark cyan ink and dark magenta ink in the first high-speed mode.
Figure 21:
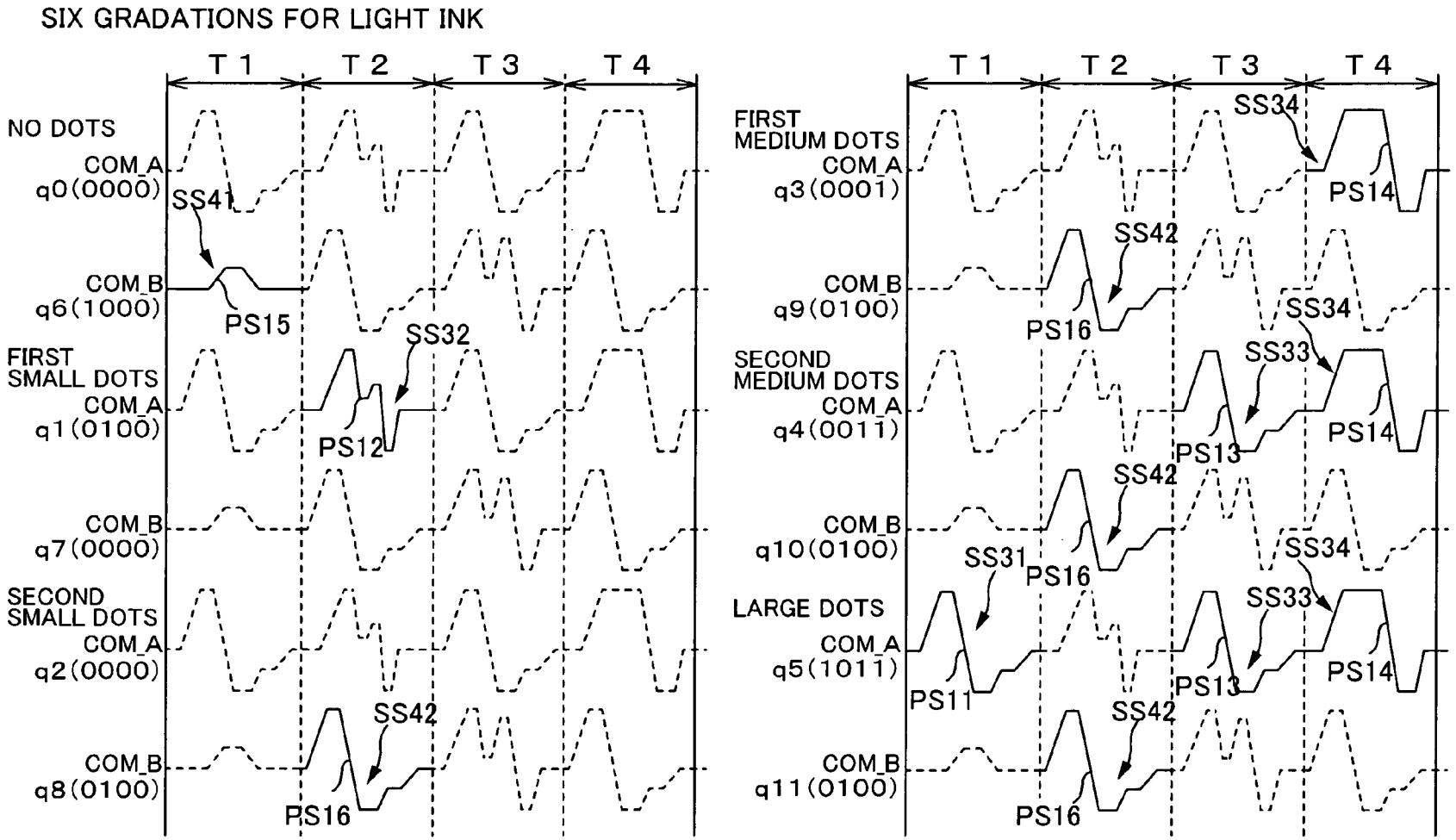
FIG. 21 is a diagram illustrating, for each type of dots, the segment signals of the driving signal applied for light cyan ink and light magenta ink in the second high-speed mode.

The following is a detailed explanation of the dot formation operation. Here, FIG. 17 is a drawing illustrating the driving signals COM (first driving signal COM_A and second driving signal COM_B) generated by the driving signal generation section 50. FIG. 18A is a diagram illustrating the driving pulses applied to the piezo elements PZT and the amount of ink ejected in the high-quality mode for each type of ink and for each dot formation data SI. FIG. 18B is a diagram illustrating the driving pulse applied to the piezo elements PZT and the amount of ink ejected in the first high-speed mode for each type of ink and for each dot formation data SI. FIG. 18C is a diagram illustrating the driving pulse applied to the piezo elements PZT and the amount of ink ejected in the second high-speed mode for each type of ink and for each dot formation data SI. FIG. 19 is a diagram illustrating for each type of dots the segment signals of the driving signals COM applied for black ink and yellow ink in the high-quality mode and the high-speed mode. FIG. 20 is a diagram illustrating for each type of dots the segment signals of the driving signal applied for dark cyan ink and dark magenta ink in the first high-speed mode. FIG. 21 is a diagram illustrating for each type of dots the segment signals of the driving signal applied for light cyan ink and light magenta ink in the second high-speed mode.

In this dot formation operation, the host-side controller 111 (printer driver) generates the dot formation data SI and updates the remaining ink amount. On the other hand, the printer-side controller 70 controls the driving signal generation section 50 and the driving signal generation section 50 generates the driving signals COM (first driving signal COM_A, second driving signal COM_B). As shown in FIG. 17, the first driving signal COM_A is made of a first segment signal SS31 generated in a period T1, a second segment signal SS32 generated in a period T2, a third segment signal SS33 generated in a period T3, and a fourth segment signal SS34 generated in a period T4. The second driving signal COM_B is made of a first segment signal SS41 generated in a period T1, a second segment signal SS42 generated in a period T2, a third segment signal SS43 generated in a period T3, and a fourth segment signal SS44 generated in a period T4. The first segment signal SS31 of the first driving signal COM_A includes a first driving pulse PS11 and the second segment signal SS32 of the first driving signal COM_A includes a second driving pulse PS12. The third segment signal SS33 includes a third driving pulse PS13 and the fourth segment signal SS34 includes a fourth driving pulse PS14. Similarly, the first segment signal SS41 of the second driving signal COM_B includes a fifth driving pulse PS15 and the second segment signal SS42 of the second driving signal COM_B includes a sixth driving pulse PS16. The third segment signal SS43 includes a seventh driving pulse PS17 and the fourth segment signal SS44 includes an eighth driving pulse PS18.

Among these driving pulses PS11 to PS18, the driving pulses PS11, PS13, PS16, and PS18 all have the same waveform, and when one driving pulse is applied to a piezo element PZT, it causes about 6 pL ink to be ejected. When the second driving pulse PS12 is applied to the piezo element PZT, about 2.5 pL ink is ejected, and when the fourth driving pulse PS14 is applied to the piezo element PZT, about 9 pL ink is ejected. Moreover, when the seventh driving pulse PS17 is applied to the piezo element PZT, about 1.6 pL ink is ejected. It should be noted that when the fifth driving pulse PS15 is applied to the piezo element PZT, the meniscus performs a micro-oscillation.

Next, the operation of applying the necessary portion of the driving signals COM to the piezo element PZT, based on the switch operation information, is explained. There are four types of dot formation data SI in the high-quality mode, corresponding to no dots, formation of small dots, formation of medium dots, and formation of large dots. Moreover, the switch operation information q0 to q7 is set as follows. As shown in FIG. 19, the switch operation information q0 corresponding to the dot formation data SI for no dots is the data [0000] and the switch operation information q4 is the data [1000]. The switch operation information q1 corresponding to the dot formation data SI for small dots is the data [0000] and the switch operation information q5 is the data [0010]. The switch operation information q2 corresponding to the dot formation data SI for medium dots is the data [0010] and the switch operation information q6 is the data [0100]. And the switch operation information q3 corresponding to the dot formation data SI for large dots is the data [1010] and the switch operation information q7 is the data [0101].

Thus, as shown in FIG. 18A, when no dots are formed, the first segment signal SS41 of the second driving signal COM_B is applied to the piezo element PZT. Then, the meniscus performs a micro-oscillation due to the fifth driving pulse PS15 included in the first segment signal SS41. In the formation of small dots, the third segment signal SS43 (seventh driving pulse PS17) of the second driving signal COM_B is applied to the piezo element PZT, and about 1.6 pL ink is ejected. In the formation of medium dots, the third segment signal SS33 (third driving pulse PS13) of the first driving signal COM_A and the second segment signal SS42 (sixth driving pulse PS16) of the second driving signal COM_B are applied to the piezo element PZT, and about 12 pL ink is ejected. In the formation of large dots, the first segment signal SS31 (first driving pulse PS11) and the third segment signal SS33 (third driving pulse PS13) of the first driving signal COM_A and the second segment signal SS42 (sixth driving pulse PS16) and the fourth segment signal SS44 (eighth driving pulse PS18) of the second driving signal COM_B are applied to the piezo element PZT, and about 24 pL ink is ejected.

On the other hand, for black ink and for yellow ink, there are four types of dot formation data SI in the first high-speed mode and the second high-speed mode, corresponding to no dots, formation of small dots, formation of medium dots, and formation of large dots. In this case, the switch operation information is the same as for the case of the high-quality mode. Therefore, further explanations thereof are omitted. Moreover, for dark cyan ink and for dark magenta ink, there are six types, namely for no dots, for the formation of first small dots, for the formation of second small dots, for the formation of first medium dots, for the formation of second medium dots, and for the formation of large dots.

In this case, the switch operation information q0 to q11 in the first high-speed mode is set as follows. As shown in FIG. 20, the switch operation information q0 corresponding to the dot formation data SI for no dots is the data [0000] and the switch operation information q6 is the data [1000]. The switch operation information q1 corresponding to the dot formation data SI for first small dots is the data [0000] and the switch operation information q7 is the data [0010]. The switch operation information q2 corresponding to the dot formation data SI for second small dots is the data [0100] and the switch operation information q8 is the data [0000]. The switch operation information q3 corresponding to the dot formation data SI for first medium dots is the data [0010] and the switch operation information q9 is the data [0100]. The switch operation information q4 corresponding to the dot formation data SI for second medium dots is the data [1010] and the switch operation information q10 is the data [0100]. And the switch operation information q5 corresponding to the dot formation data SI for large dots is the data [1010] and the switch operation information q11 is the data [0101].

Thus, as shown in FIG. 18B, when no dots are formed, the first segment signal SS41 of the second driving signal COM_B (fifth driving pulse PS15) is applied to the piezo element PZT, and the meniscus performs a micro-oscillation. In the formation of first small dots, the third segment signal SS43 (seventh driving pulse PS17) of the second driving signal COM_B is applied to the piezo element PZT, and about 1.6 pL ink is ejected. In the formation of second small dots, the second segment signal SS32 (second driving pulse PS12) of the first driving signal COM_A is applied to the piezo element PZT, and about 2.5 pL ink is ejected. In the formation of first medium dots, the third segment signal SS33 (third driving pulse PS13) of the first driving signal COM_A and the second segment signal SS42 (sixth driving pulse PS16) of the second driving signal COM_B are applied to the piezo element PZT, and about 12 pL ink is ejected. In the formation of second medium dots, the first segment signal SS31 (first driving pulse PS11) and the third segment signal SS33 (third driving pulse PS13) of the first driving signal COM_A and the second segment signal SS42 (sixth driving pulse PS16) of the second driving signal COM_B are applied to the piezo element PZT, and about 18 pL ink is ejected. In the formation of large dots, the first segment signal SS31 (first driving pulse PS11) and the third segment signal SS33 (third driving pulse PS13) of the first driving signal COM_A and the second segment signal SS42 (sixth driving pulse PS16) and the fourth segment signal SS44 (eighth driving pulse PS18) of the second driving signal COM_B are applied to the piezo element PZT, and about 24 pL ink is ejected.

Moreover, the switch operation information q0 to q11 in the second high-speed mode is set as follows. As shown in FIG. 21, the switch operation information q0 corresponding to the dot formation data SI for no dots is the data [0000] and the switch operation information q6 is the data [1000]. The switch operation information q1 corresponding to the dot formation data SI for first small dots is the data [0100] and the switch operation information q7 is the data [0000]. The switch operation information q2 corresponding to the dot formation data SI for second small dots is the data [0000] and the switch operation information q8 is the data [0100]. The switch operation information q3 corresponding to the dot formation data SI for first medium dots is the data [0001] and the switch operation information q9 is the data [0100]. The switch operation information q4 corresponding to the dot formation data SI for second medium dots is the data [0011] and the switch operation information q10 is the data [0100]. And the switch operation information q5 corresponding to the dot formation data SI for large dots is the data [1011] and the switch operation information q11 is the data [0100].

Thus, as shown in FIG. 18C, when no dots are formed, the first segment signal SS41 (fifth driving pulse PS15) of the second driving signal COM_B is applied to the piezo element PZT, and the meniscus performs a micro-oscillation. In the formation of first small dots, the second segment signal SS32 (second driving pulse PS12) of the first driving signal COM_A is applied to the piezo element PZT, and about 2.5 pL ink is ejected. In the formation of second small dots, the second segment signal SS42 (sixth driving pulse PS16) of the second driving signal COM_B is applied to the piezo element PZT, and about 6 pL ink is ejected. In the formation of first medium dots, the fourth segment signal SS34 (fourth driving pulse PS14) of the first driving signal COM_A and the second segment signal SS42 (sixth driving pulse PS16) of the second driving signal COM_B are applied to the piezo element PZT, and about 15 pL ink is ejected. In the formation of second medium dots, the first segment signal SS33 (third driving pulse PS13) and the fourth segment signal SS34 (fourth driving pulse PS14) of the first driving signal COM_A and the second segment signal SS42 (sixth driving pulse PS16) of the second driving signal COM_B are applied to the piezo element PZT, and about 21 pL ink is ejected. In the formation of large dots, the first segment signal SS31 (first driving pulse PS11), the third segment signal SS33 (third driving pulse PS13) and the fourth segment signal SS34 (fourth driving pulse PS14) of the first driving signal COM_A and the second segment signal SS42 (sixth driving pulse PS16) of the second driving signal COM_B are applied to the piezo element PZT, and about 27 pL ink is ejected.

Thus, in the printer 1 of the present embodiment, regarding the high-speed mode in which printing is performed with six types of dot formation data SI using four types of ink, it is possible to select between the first high-speed mode, which uses dark cyan ink, dark magenta ink, black ink, and yellow ink, and the second high-speed mode, which uses light cyan ink, light magenta ink, black ink, and yellow ink. Therefore, the following effects are displayed in addition to the effects of the first embodiment.

With this printing system 100, when the high-quality mode has been set as the print mode, if the printer driver judges that the remaining amount of ink for at least one of dark cyan ink and dark magenta ink is insufficient, then the print mode is switched to the second high-speed mode. Thus, printing is performed using four types of ink, namely light cyan ink, light magenta ink, black ink, and yellow ink.

In the second high-speed mode (corresponding to the second print mode using light ink), the amount of light cyan ink and light magenta ink that is ejected in large dots (corresponding to a large dot gradation value) is larger than the amount of light cyan ink and light magenta ink that is ejected for large dots in the high-quality mode. With this configuration, the maximum print resolution for light ink in the second high-speed mode can be made darker than the maximum print resolution for light ink in the high-quality mode. As a result, it is possible to suppress a deterioration of image quality caused by the fact that no dark ink is used.

Moreover, as can be seen from comparing FIG. 18B and FIG. 18C, the amount of light ink that is ejected for each of the dot formation data SI (each dot gradation value) in the second high-speed mode, is larger than the amount of dark ink that is ejected for the dot formation data SI corresponding to the second high-speed mode. For example, for the formation of first small dots (data [001]), the amount of ejected dark ink is about 1.6 pL, whereas the amount of ejected light ink is about 2.5 pL. And for the formation of second small dots (data [100]), the amount of ejected dark ink is about 2.5 pL, whereas the amount of ejected light ink is about 6 pL. Similarly, for the formation of first medium dots (data [100]), the amount of ejected dark ink is about 12 pL, whereas the amount of ejected light ink is about 15 pL. In the second high-speed mode, by setting the amount of ejected light ink corresponding to each of the dot formation data SI in this manner, it is possible to improve the darkness insufficiencies in the image caused by the use of light ink. It should be noted that the amount of ejected light ink corresponding to each of the dot formation data SI should be set suitably in accordance with the ratio of light ink to dark ink.

Other Embodiments

The above embodiments primarily describe a printer 1, but also include the disclosure of a printing apparatus, a printing method, a printing system, and a program, for example. Also, a printer 1 serving as an embodiment was described above. However, the foregoing embodiments are for the purpose of elucidating the present invention and are not to be interpreted as limiting the present invention. The invention can of course be altered and improved without departing from the gist thereof and includes functional equivalents. In particular, the embodiments mentioned below are also included in the scope of invention.

Switching of the Print Modes

The above-described embodiments relate to configurations in which the print mode can be switched based on the amount of remaining dark ink and light ink of cyan and magenta, but there is no limitation to such a configuration. For example, a configuration is also possible in which the user can select the print mode. In this case, the print mode is selected via a user interface of the printer driver. Alternatively, the user is notified by the printer 1 of the fact that the amount of remaining dark ink or light ink of cyan or magenta is low, and the print mode is switched based on a selection of the print mode by the user in response to this notification.

Also with these configuration, it is possible to achieve, at a high level, both faster printing and higher image quality.

Gradation Values

In the above-explained embodiments, a printing system 100 was explained in which there are four types (number of dot gradation values) of the dot formation data SI in the high-quality mode, but there is no limitation to this configuration. For example, the number of types of dot formation data SI may also be three or six. In this case, the number of types of dot formation data SI of the cyan ink or the magenta ink in the high-speed mode is set to a larger number than the number of types of dot formation data SI in the high-quality mode.

Driving Signals

The above-described embodiments used two types of driving signals COM, namely a first driving signal COM_A and a second driving signal COM_B, but there is no limitation to such a configuration. For example, it is also possible to use three or more types of driving signals COM, and it is also possible to use a single type of driving signals. By using a plurality of types of driving signals COM, it is possible to include many types of segment signals (driving pulses), even when there is a limited repetition period T. As a result, even when the number of types of dot formation data SI in the high-speed mode is increased, it can be prevented that the generation time of the driving signals COM becomes too long, and thus a speeding up of the printing process can be achieved. That is to say, the speed in the carriage movement direction can be increased, and both an improvement of image quality and an improvement of the printing speed can be achieved.

Ink Colors

In the above-explained embodiments, a printing system 100 was explained as an example which uses dark cyan ink and light cyan ink when performing printing gradually dark and light of cyan, and which uses dark magenta ink and light magenta ink when performing printing gradually dark and light of magenta. However, the dark ink and the light ink used for printing gradually dark and light is not limited to cyan and magenta, but can also be another color. For example, if gradation printing of black is carried out, it is also possible to use black ink and grey ink. And if gradation printing of sepia is carried out, it is also possible to use dark sepia ink and light sepia ink. Here, cyan and magenta have a large influence on the color tone in color printing. Therefore, in printing systems in which printing gradually dark and light is performed using dark inks and light inks, a more pronounced operational effect is attained when switching the print modes as explained above for cyan and magenta.

Printer 1

In the above-explained embodiments, a printer 1 was explained as an example in which printing is performed while moving the carriage CR to which the head 41 (head unit 40) is attached in the carriage movement direction, but there is no limitation to this configuration. For example, it is also possible to apply the present invention to a printer having a line head in which a head 41 (nozzles Nz) is arranged in a direction intersecting with (more preferably perpendicular to) the transport direction of the paper S.

Also, in the above-described embodiment, a printing system 100 was explained that includes a printer 1 with the single function of printing only, but there is no limitation to such a printer 1. For example, the apparatus may also be a so-called printer-scanner multi-functional device that has both the function of the printer 1 and the function of a scanner device. Moreover, the printer driver may be stored in a memory of the printer 1 or of the multi-functional device. In this case, the printer driver is executed by the CPU of the printer-side controller. Instead of the printer 1, it is also possible to apply the invention to a plotter or a facsimile device. Furthermore, technology like that of the present embodiments can also be adopted for various types of printing apparatuses that use inkjet technology, including color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices. Also, these methods and manufacturing methods are within the scope of application.

The Elements of the Head 41

In the foregoing embodiments, piezo elements PZT were given as an example of the elements of the head 41, that is, the elements operating to eject ink, but there is no limitation to piezo elements PZT. For example, the elements of the head 41 may also be electrostatic actuators, magnetostrictive elements, or heater elements.

What is claimed is:

1. A printing method comprising:

determining either one of a first print mode, which uses both a dark ink and a light ink used for printing gradually dark and light of a given color and which prints with a predetermined number of types of dot gradation values, which is a plurality of types of dot gradation values, based on sizes of dots to be formed, and a second print mode, which uses one of the dark ink and the light ink and which prints with the number of types of dot gradation values larger than the predetermined number, which is a plurality of types of dot gradation values, based on the sizes of the dots to be formed; and determining a dot gradation value corresponding to the size of the dot to be formed, from among the number of the types of the dot gradation values corresponding to the determined print mode, and ejecting the dark ink and the light ink from a head in accordance with the determined dot gradation value.

2. A printing method according to claim 1, further comprising:

if the first print mode is determined as the print mode performing a control and if for another of the dark ink and the light ink, a remaining ink amount detected by a remaining ink amount detector is smaller than a reference amount, switching the print mode performing the control from the first print mode to the second print mode.

3. A printing method according to claim 2, wherein in the first print mode, both the dark ink and the light ink used for printing gradually dark and light of a given color as well as both another dark ink and another light ink used for printing gradually dark and light of another color are used, and printing is performed with a predetermined number of types of dot gradation values, which is a plurality of types of dot gradation values, based on the sizes of the dots to be formed, and wherein in the second print mode, one of the dark ink and the light ink as well as one of the other dark ink and the other light ink are used, and printing is performed with the number of types of dot gradation values larger than the predetermined number, which is a plurality of types of dot gradation values, based on the sizes of the dots to be formed, and if the print mode performing the control is switched from the first print mode to the second print mode, for the other dark ink and the other light ink, regardless of the remaining ink amount of another of the other dark ink and the other light ink, one of the other dark ink and the other light ink is used, and printing is performed using the number of types of dot gradation values larger than the predetermined number.

4. A printing method according to claim 3, wherein the dark ink and the light ink are one of a cyan dark ink and light ink and a magenta dark ink and light ink, and the other dark ink and the other light ink are another of the cyan dark ink and light ink and the magenta dark ink and light ink.

5. A printing method according to claim 2, wherein the remaining ink amount detector includes counters counting the number of ink ejections individually for each ink type and detects the remaining ink amount individually for each type of the ink, based on the count values of the counters.

6. A printing method according to claim 5, wherein the remaining ink amount detector stores the count values of the counters in a non-volatile memory of an ink storage container in which ink is stored.

7. A printing method according to claim 2, wherein the reference amount is an amount that is determined based on a remaining ink amount at which damage is caused when printing.

8. A printing method according to claim 1, wherein the head includes a plurality of nozzle rows each made of a plurality of nozzles from which ink is ejected, the nozzle rows being lined up in a movement direction of the head, and ink not used in the second print mode is ejected from nozzle rows, of a plurality of the nozzle rows, that are positioned at one end in the movement direction.

9. A printing method according to claim 1, wherein the head includes a plurality of nozzle rows each made of a plurality of nozzles from which ink is ejected, the nozzle rows being lined up in a movement direction of the head, and wherein nozzle rows not ejecting ink in the second print mode are not positioned between nozzle rows, of a plurality of the nozzle rows, ejecting ink in the second print mode.

10. A printing method according to claim 1, wherein in the second print mode, the dark ink is used, and a difference of an ink amount for a given dot gradation value and the next dot gradation value is smaller than a difference between an ink amount for a given dot gradation value and the next dot gradation value in the first print mode.

11. A printing method according to claim 1, wherein in the second print mode, the light ink is used, and the amount of the light ink that is ejected at a maximum dot gradation value is larger than the amount of the light ink that is ejected at a maximum dot gradation value of the first print mode.

12. A printing method according to claim 1, wherein to eject ink from the head, a plurality of driving signals are generated in a given period, a necessary portion is selected from a plurality of the driving signals, in accordance with the determined print mode, and the selected necessary portion is applied to an element of the head, the element performing an operation causing ink to be ejected.

13. A printing method according to claim 1, wherein in the first print mode, both the dark ink and the light ink stored in an ink storage container are used, and the ink storage container includes a case provided with a plurality of ink storage chambers, and a plurality of types of inks including the dark ink and the light ink used for gradation printing of the given color and an ink other than the dark ink and the light ink of the given color are stored in the corresponding ink storage chambers, and in the second print mode, one of the dark ink and the light ink stored in the ink storage container is used.

* * * * *